US011297435B2

(12) United States Patent
Hanada

(10) Patent No.: US 11,297,435 B2
(45) Date of Patent: Apr. 5, 2022

(54) VOICE COIL DIAPHRAGM

(71) Applicant: Akito Hanada, Kitakyushu (JP)

(72) Inventor: Akito Hanada, Kitakyushu (JP)

( * ) Notice: Subject to any disclaimer, the term of this patent is extended or adjusted under 35 U.S.C. 154(b) by 0 days.

(21) Appl. No.: 17/255,065

(22) PCT Filed: Jun. 26, 2018

(86) PCT No.: PCT/JP2018/024208
§ 371 (c)(1),
(2) Date: Dec. 22, 2020

(87) PCT Pub. No.: WO2020/003381
PCT Pub. Date: Jan. 2, 2020

(65) Prior Publication Data
US 2021/0136496 A1 May 6, 2021

(51) Int. Cl.
*H04R 7/04* (2006.01)
*H04R 7/16* (2006.01)
*H04R 9/02* (2006.01)
*H04R 9/06* (2006.01)

(52) U.S. Cl.
CPC ..... *H04R 7/04* (2013.01); *H04R 7/16* (2013.01); *H04R 9/025* (2013.01); *H04R 9/06* (2013.01)

(58) Field of Classification Search
CPC ..... H04R 7/04; H04R 9/00; H04R 9/047
See application file for complete search history.

(56) References Cited

U.S. PATENT DOCUMENTS 7,912,239 B2 * 3/2011 Nishimura ..... H04R 9/06 381/396
2004/0070294 A1 4/2004 Hanada
2005/0152577 A1 7/2005 Nishimura et al.
(Continued)

FOREIGN PATENT DOCUMENTS

CN 101138272 A 3/2008
CN 101578889 A 11/2009
(Continued)

OTHER PUBLICATIONS

International Search Report dated Oct. 2, 2018, issued in counterpart International Application No. PCT/JP2018/024208, with English Translation. (3 pages).
(Continued)

*Primary Examiner* — Sunita Joshi
(74) *Attorney, Agent, or Firm* — Westerman, Hattori, Daniels & Adrian, LLP

(57) ABSTRACT

A coil body 30 has a conductive part 32, which is made of a conductive body 31 or of a plurality of conductive bodies 31 arranged side by side in a planar shape, and an insulating part 33 for insulating the conductive part 32. The conductive body 31, or the conductive bodies 31, and the insulating part 33 are arranged in a winding state, thereby a plurality of wound parts 34 that are separated from each other and arranged side by side are formed in the coil body 30. The wound parts 34 are arranged in a manner where each wound part 34 comes into a partial contact with an adjacent one or more of the other wound parts 34 at least when vibrating and is linked by movable linking parts 41 with other ones of the wound parts 34 arranged side by side.

6 Claims, 18 Drawing Sheets

(56) References Cited

U.S. PATENT DOCUMENTS

| | | | | |
|---|---|---|---|---|
| 2008/0087493 | A1* | 4/2008 | Ikeda | H04R 7/045 181/167 |
| 2010/0278371 | A1 | 11/2010 | Hanada | |
| 2012/0051557 | A1 | 3/2012 | Horigome et al. | |
| 2013/0163807 | A1 | 6/2013 | Lin | |
| 2017/0150274 | A1 | 5/2017 | Sakane | |

FOREIGN PATENT DOCUMENTS

| | | | |
|---|---|---|---|
| CN | 106465017 | A | 2/2017 |
| JP | 2002-204495 | A | 7/2002 |
| JP | 2003-125486 | A | 4/2003 |
| JP | 3612319 | B2 | 1/2005 |
| JP | 2006-067112 | A | 3/2006 |
| JP | 2006-287924 | A | 10/2006 |
| JP | 2006-339836 | A | 12/2006 |
| JP | 4810576 | B2 | 11/2011 |
| KR | 10-2015-0137517 | A | 12/2015 |
| WO | 2017/145284 | A1 | 8/2017 |

OTHER PUBLICATIONS

Decision to Grant a Patent dated Dec. 18, 2018, issued in counterpart of Japanese Patent Application No. 2018-558371 with English Translation (5 pages).

Jian-Jun Zhou, "Design of a flat-panel loudspeaker with giant magnetostrictive exciters", IEEE Conference Publication, 2008 Symposium on Piezoelectricity, Acoustic Waves, and Device Applications, Feb. 6, 2009, cited in CN Office Action dated Jun. 15, 2021. (3 pages).

Gao Huichao et al., "Multi-unit coherent driving area array loudspeaker technology", Electroacoustic Technology, 2007, No. 8, pp. 21-26, with English translation, cited in CN Office Action dated Jun. 15, 2021. (4 pages).

Office Action dated Jun. 15, 2021, issued in counterpart CN application No. 201880094295.X, with English translation. (11 pages).

* cited by examiner

VOICE COIL DIAPHRAGM

TECHNICAL FIELD

The present invention is related to a voice coil diaphragm applied to an electroacoustic transducer that converts electrical signals into sound, such as a loudspeaker, headphones, and earphones, and an electroacoustic transducer that receives sound and converts the sound into electrical signals, such as a microphone and an acoustic wave sensor.

BACKGROUND ART

In a cone loudspeaker that has the most common structure as a conventional loudspeaker, vibrations generated by a voice coil come out as sound after going through a voice coil bobbin and further a diaphragm. In a precise sense, in addition to the above, the vibrations go through the insulator of the voice coil, glue for joining various parts, and the like. Accordingly, the sound quality of the cone loudspeaker deteriorates through the process where the vibrations go through the various materials and propagate. Besides, the propagation of the vibrations causes phase-lag vibrations and divided vibrations. To cope with this, e.g., patent literature 1 suggests a loudspeaker using a voice coil diaphragm formed in a planar shape by winding a conductive body (conductive part). In the voice coil diaphragm, the conductive body that generates vibrations serves as both the driving part and the diaphragm. So, in principle, the vibrations generated at various parts of the conductive body are directly emitted as sound without propagating to other parts.

FIG. 18 shows a part of a loudspeaker (an example of an electroacoustic transducer) 10Z adopting a circular voice coil diaphragm similar to the one described in patent literature 1, and is a cross-sectional view illustrating the operational principle of the loudspeaker 10Z and showing only the main part. A voice coil diaphragm 20Z used for the loudspeaker 10Z includes conductive bodies 31*z*, which are wound with gaps 33*z* and disposed on a sheet-like supporting body 40*z*, and the voice coil diaphragm 20Z is configured by integrating the conductive bodies 31*z* that generate a driving force and the supporting body 40*z*. FIG. 18 shows a part of a cross-section of the loudspeaker 10Z cut along a radial direction of the voice coil diaphragm 20Z. Since the conductive bodies 31*z* are made into a winding state with the gaps 33*z* provided, the conductive bodies 31*z* has a structure in which they are insulated from each other. Incidentally, the upward direction and the downward direction of FIG. 18 are the front side direction and the back side direction, respectively, of the electroacoustic transducer 10Z (the voice coil diaphragm 20Z). The reference sign x represents the width directions of the conductive body 31*z* (i.e. radial directions of the voice coil diaphragm 20Z) that are parallel to the surface of the voice coil diaphragm 20Z, whereas the reference sign y represents the vibrating directions of the conductive body 31*z* (i.e. the axial directions [front-back directions] of the voice coil diaphragm 20Z) that are perpendicular to the surface of the voice coil diaphragm 20Z. In this structure, the supporting body 40*z* has movable parts 42*z* not facing the conductive body 31*z*, and joined supporting parts 43*z* joined with the conductive body 31*z*. On the back side of the voice coil diaphragm 20Z, a circular-plate shaped magnet plate 60Z is disposed so as to face to the back side of the voice coil diaphragm 20Z, and the magnet plate 60Z is configured of a plurality of band-shaped magnets 65*z* concentrically arranged so as to be parallel to each other. The band-shaped magnets 65*z* are magnetized in the axial directions (the y directions), and the ones being magnetized in the front side direction of the axial directions and the ones being magnetized in the back side direction of the axial directions are alternately disposed in the radial directions of the magnet plate 60Z.

By the magnet plate 60Z configured as described above, a magnetic field crossing the conductive bodies 31*z* is created, and thus, the conductive bodies 31*z* generate an electro-magnetic force upon supply with the acoustic signal current to the conductive bodies 31*z*. By using this electromagnetic force, the loudspeaker 10Z generates sound by vibrating the voice coil diaphragm 20Z that includes the conductive bodies 31*z* and the supporting body 40*z* integrated with each other. Incidentally, the reference sign 85*z* represents a back frame that is made of a nonmagnetic material and supports the magnet plate 60Z from behind. Since the loudspeaker 10Z using this voice coil diaphragm 20Z has a structure where the conductive bodies 31*z* are disposed over almost the entire area of the voice coil diaphragm 20Z, almost the entire surface of the voice coil diaphragm 20Z is driven in the same phase. Therefore, the loudspeaker 10Z has a feature that excellent transient characteristics can be obtained.

In this structure, the conductive bodies 31*z* are arranged to have the gaps 33*z* provided in the radial directions (the x directions), and the movable parts 42*z* of the supporting body 40*z* do not face the conductive bodies 31*z*. Therefore, the stiffness of the movable parts 42*z* is lower than the stiffness of the other area (i.e. the stiffness of the joined supporting parts 43*z*). This allows displacements of the conductive bodies 31*z* in the y directions (hereinafter, referred to as "front-back direction displacements") to occur, and this enables the conductive bodies 31*z* to vibrate in the originally intended vibrating directions (i.e. the directions perpendicular to the surface of the voice coil diaphragm 20Z).

In this case, however, the conductive bodies 31*z* become to displace also in the x directions (hereinafter, referred to as "width direction displacements") that are the width directions of the conductive bodies 31*z* (i.e. the radial directions of the voice coil diaphragm 20Z) due to the lower stiffness of the movable parts 42*z*. This causes the vibrations of the conductive bodies 31*z* to be complicating, thereby having been a major cause of abnormal vibrations called flutter.

Also, in the structure shown in FIG. 18, the conductive bodies 31*z* need to be disposed so as to accord with the directions of the magnetic field of a large number of the band-shaped magnets 65*z* that configure the magnet plate 60Z, and thus, the conductive bodies 31*z* need portions where the winding direction reverses. Therefore, the conductive bodies 31*z* can neither be arranged with even intervals nor axisymmetrically on the voice coil diaphragm 20Z (supporting body 40*z*). As a result, the driving force generated by the conductive bodies 31*z* and the stiffness of the movable parts 42*z* are neither even nor axisymmetry on the voice coil diaphragm 20Z, and this also has been a reason that leads to occurrence of the abnormal vibrations. Particularly at the places where the directions of magnetic fields of the magnet plate 60Z (band-shaped magnets 65*z*) are reversed, the strength of the magnetic fields deteriorates, and so, the conductive bodies 31*z* must be disposed while avoiding those places. By this, the area that is occupied by the movable parts 42*z* expands. This means that the stiffness of the expanded area decreases and the width direction displacements of the conductive bodies 31*z* become likely to occur, and this has been a major cause of the abnormal vibrations.

In the case of the structure shown in FIG. 18, the abnormal vibrations can be decreased by making thicker the entire supporting body 40*z* to increase the stiffness of the movable parts 42*z*. In this case, however, a problem occurs that the sound quality deteriorates because substances other than the driving part (conductive bodies 31*z*) increase. In this way, improving the sound quality and preventing the abnormal vibrations are in a tradeoff relationship, and thus, it has been difficult to realize an ideal loudspeaker.

Further, as the area and the amplitude of the voice coil diaphragm become larger, the range in which the width direction displacements affect on each other expands, and the abnormal vibrations become more likely to occur. The lower the frequency to be reproduced by a loudspeaker is, the wider the area of the voice coil diaphragm needs to become, and the amplitude of the voice coil diaphragm becomes larger. Therefore, the abnormal vibrations have been a major problem in designing loudspeakers for the mid-frequency range and the low-frequency range.

In order to solve such problems, the present inventor developed a new electroacoustic transducer of patent literature 2 based on his diligent study, and has obtained the patent right. The electroacoustic transducer of patent literature 2 has a new magnetic field generating structure capable of distributing strong magnetic fields to a wider area. Besides, the electroacoustic transducer of patent literature 2 does not have any place to be avoided from disposing the conductive bodies on, and thus, the conductive bodies can be evenly arranged over the entire voice coil diaphragm. Also the conductive bodies do not need to reverse the winding direction. Therefore, by providing a movable supporting part (not shown in the figures) at the inner peripheral part and the outer peripheral part of the voice coil diaphragm of patent literature 2 to enable the front-back direction displacements, it succeeded in completely eliminating the gaps 33*z* that are provided when arranging the conductive bodies 31*z*, and the movable parts 42*z* of the supporting body 40*z* both shown in FIG. 18. Incidentally, each movable supporting part is provided with a corrugation or the like to make the voice coil diaphragm (conductive bodies 31*z*) less likely to displace in the width directions. As a result, a voice coil diaphragm, in which the conductive bodies are joined together in a manner where the conductive bodies are insulated but closely attached with each other, became able to be adopted. This managed to dramatically decrease the occurrence of the abnormal vibrations derived from the width direction displacements. The present inventor then developed a method for manufacturing a voice coil diaphragm in which the conductive bodies are joined together in a manner where the conductive bodies are insulated but closely attached with each other, and applied for a patent of patent literature 3.

By the above, a large size voice coil diaphragm became able to be adopted, and this made it possible to manufacture a loudspeaker that is less likely to generates the abnormal vibrations and is capable of reproducing the mid-frequency range and the low-frequency range. In other words, it has become possible to manufacture a loudspeaker adopting a voice coil diaphragm for over the entire band range. The present inventor then established a technique for simplifying the configuration of the magnet plate through repeated improvements, and has also obtained the patent right of patent literature 4.

Additionally, the present inventor developed a method for improving the use efficiency of the magnets by adopting a voice coil diaphragm in a three dimensional shape that has vibrating surfaces inclined or perpendicular to the surface of the magnet plate, and applied for a patent of patent literature 5.

CITATION LIST

Patent Literature

Patent Literature 1: Japanese Unexamined Patent Application Publication No. 2003-125486

Patent Literature 2: Japanese Patent No. 3612319

Patent Literature 3: Japanese Unexamined Patent Application Publication No. 2006-339836

Patent Literature 4: Japanese Patent No. 4810576

Patent Literature 5: International Publication No. WO 2017/145284

SUMMARY OF INVENTION

Technical Problem

As explained above, the present inventor has solved the problems such as the abnormal vibrations of the loudspeaker concerning over the entire band range by adopting the voice coil diaphragm in which the conductive bodies are joined together in a manner where the conductive bodies are insulated but closely attached with each other. However, in order to bring out in an ideal form the advantage of the voice coil diaphragm that directly emits sound from the conductive bodies, and further in order to improve the sound quality, it is required to prevent the vibrations generated by the conductive bodies from propagating to other parts. That is, it is necessary to reduce restrictions to the vibrations of the conductive bodies and allow each part of the coil body (i.e. each conductive body) to vibrate independently (i.e. to vibrate without affecting on other parts). Nevertheless, merely providing a supporting body having movable parts with a low stiffness to cope with this, as was mentioned above, triggers the width direction displacements of the conductive bodies, and this ends up in causing the abnormal vibrations. In light of this, the voice coil diaphragm is required to have a low stiffness over the entire surface and a structure in which the vibrations of the parts of the coil body are less likely to affect on each other, and besides, the width direction displacements of the conductive bodies must be suppressed even in such a condition. Such a voice coil diaphragm with a structure in which the vibrations of the conductive bodies are less likely to propagate to the other parts and the abnormal vibrations are less likely to occur, has been strongly demanded.

The present invention has been made to meet the demand mentioned above, and has as its object to provide a voice coil diaphragm capable of improving the qualities of electroacoustic transducers by maintaining the vibrations in the originally intended vibrating directions of the conductive part (the conductive bodies) and suppressing displacements in other directions to prevent the abnormal vibrations, and also by making the vibrations of the conductive part less likely to propagate to other parts.

Solution to Problem

In order to achieve the above object, a voice coil diaphragm according to the present invention having a planar coil body formed with a conductive part in a winding state, being disposed facing a magnet plate, being used in (a) an electroacoustic transducer generating sound by vibrating the conductive part by using an electro-magnetic force, the electro-magnetic force generated by a magnetic field and an acoustic signal current, the magnetic field created by the magnet plate, the acoustic signal current flowing in the conductive part, or (b) an electroacoustic transducer generating an acoustic signal current in the conductive part by using a magnetic field and vibrations of the conductive part, the magnetic field created by the magnetic plate, the vibrations of the conductive part deriving from sound, the coil body of the voice coil diaphragm includes:

the conductive part composed of a conductive body or of a plurality of conductive bodies arranged side by side so as to be in a planar shape; and an insulating part for insulating the conductive part, wherein a plurality of wound parts that are separated from each other and arranged side by side are formed in the coil body by arranging the conductive body, or the conductive bodies, and the insulating part in a winding state, further wherein the wound parts (1) are disposed in a manner where each of the wound parts comes into a partial contact with an adjacent one or more of the other wound parts at least when vibrating, and are each linked by movable linking parts with other ones of the wound parts arranged side by side, or (2) are each joined intermittently in the winding direction with an adjacent one or more of the other wound parts by using joining parts.

Although the voice coil diaphragm (the coil body) usually has a planar annular shape as a whole, the outer shape may be an ellipse or a quadrilateral. In the cases where the voice coil diaphragm has an annular shape and the conductive part (the conductive body/bodies) is circularly wound, the width directions of the conductive body/bodies are the radial directions of the voice coil diaphragm. As the material for the conductive part (the conductive body/bodies), a non-magnetic metal, such as copper, aluminum, copper-clad aluminum, silver, gold, or the like, is used. The coil body is separated into units, and the wound parts each represent one of the separated units. By making the winding state into a spiral state, the wound parts having different orbits are formed side by side in the radial directions. The movable linking parts are only required to link each wound part formed in the coil body with the other ones of the wound parts arranged side by side, and do not necessarily need to link adjacent (i.e. the closest) ones of the wound parts. In other words, it is sufficient that the wound parts are linked with each other at necessary points by using the movable linking parts so as to support each other in the coil body. For instance, when linking two of the wound parts by one of the movable linking parts, the movable linking part may link them in a manner where the movable linking part strides over one or more of the other wound parts located in between the two wound parts to be linked.

In the voice coil diaphragm according to the present invention, it is preferred that a supporting body with which the movable linking parts are provided be included, the supporting body be disposed on one side of the coil body, and the movable linking parts each include a movable part, which faces the wound parts but is not joined with the wound parts, and two joined supporting parts, which are located one by one at both ends of the movable part and each joined with at least one of the wound parts.

As the supporting body, one formed in a film-like state (a tabular state) is suitably used, however, the supporting body does not necessarily need to cover the entire surface of the coil body, and the supporting body may be one that partially covers the coil body or may be one formed into a net shape. Also, the supporting body may be separated into a plural number, and the plurally separated ones each formed in a state of a band, a line (string), or the like may be appropriately arranged. Further, the supporting body does not necessarily need to be in a sheet-like state, and it is also possible to use one that is formed by knitting, e.g., thread-like fibers into a predetermined shape such as a planar shape or a band shape. Thus, there can be a various shapes. As the material for the supporting body, a material with an excellent stretchability (elasticity) such as a silicone resin, a synthetic rubber, a natural rubber, is suitably used. In addition, there are, e.g., ones with a stretchability improved by knitting a fibrous material (substance). However, there may be the cases where the voice coil diaphragm utilizes the elasticity of, e.g., the wound parts, and the supporting body does not always need the stretchability. As the material for the supporting body other than the above, there are, e.g., a nonmagnetic synthetic resin such as polyimide, polyamide, polyethylene, polycarbonate, or alternatively, a synthetic fiber or a wood fiber. Note that the movable parts, which face the wound parts but are not joined with the wound parts, are each formed in a region that is overlapped by the wound parts when viewed from above, and so, it is not required to expand the intervals between the adjacent wound parts to form the movable parts.

In the voice coil diaphragm according to the present invention, it is preferred that the joining parts be staggered with respect to the winding direction and the width directions of the wound parts.

In the voice coil diaphragm according to the present invention, it is preferred that the conductive part have a coating film on a part of or the whole of the conductive part.

In the cases where the conductive part is composed of a plurality of the conductive bodies, "the conductive part has a coating film on a part of the conductive part" includes cases where any one of or some of the conductive bodies has/have the coating film on a part of or the whole of the conductive body/bodies. Incidentally, it is more advantageous in terms of sound quality when the conductive body/bodies on the front side of the voice coil diaphragm is/are exposed because sound can be emitted directly from the conductive body/bodies. For this reason, usually it is preferred that the conductive body/bodies serving as the driving part do not have the coating film. So, in the cases of, e.g., providing the coating film for the purpose of reducing the friction due to the contact between the adjacent conductive bodies during vibration, not all the conductive bodies have to have the coating film, and thus, it is recommended to adopt, e.g., a method of alternately arranging the conductive bodies having the coating film and the conductive bodies not having the coating film. Alternatively, a method such as providing the coating film only to the portions where the conductive bodies come into contact with each other can be adopted. By decreasing the coating film in this way, it is possible to suppress the sound quality deterioration. However, in the cases of providing the coating film in order, e.g., to prevent the formation of rust on the surfaces of the conductive bodies, all the conductive bodies need to be provided with the coating film. Therefore, it is necessary to comprehensively determine the extent, to which the coating film is to be provided on the conductive part that is the driving part, in consideration of the purpose of providing the coating film, the improvement effect, the influence on the sound quality, and the like. In the cases of using as the driving part the conductive bodies covered by an insulating coating film, the insulating coating film serves as the insulating part, and thus, there is no need to provide another insulating part separately. In the cases of using the conductive bodies having the coating film, the influence of the coating film affecting on the sound quality varies depending on the material of the coating film. Generally, for a high sound quality, the coating film should be thin, light, and hard. Although polyester coating films and polyurethane coating films are frequently used as the insulating coating film, influences to the sound quality can be reduced by using a hard ceramic made of, e.g., zirconium. Also, a thin and hard insulating coating film can be obtained by using a method of forming an anodized coating film on the surface of an aluminum wire that is a conductive body (i.e. so-called "alumite treatment").

In the voice coil diaphragm according to the present invention, it is preferred that the conductive part be composed of a plurality of the conductive bodies arranged side by side and that adjacent ones of the conductive bodies that have the insulating part therebetween be joined by the insulating part.

As the method for joining the adjacent conductive bodies using the insulating part, there are ways such as joining the adjacent conductive bodies while putting the insulating part therebetween and holding it from both sides, or joining the adjacent conductive bodies while filling the insulating part into a pre-formed groove (gap) between the adjacent conductive bodies. Note that the total cross-sectional area of the adjacent conductive bodies having the insulating part therebetween is preferred to be equal to the cross-sectional area of each of the other conductive bodies that does not have the insulating part. By this, the mechanical properties of the two conductive bodies joined by the insulating part and each of the other conductive bodies that does not sandwich the insulating part can be made to be uniform, all the parts of the coil body (the wound parts) vibrate in an even manner, and the uniform vibrations are obtained over the entire surface of the voice coil diaphragm.

In the voice coil diaphragm according to the present invention, it is preferred that the insulating part be composed of a conductive body not for driving and an insulating coating film for covering the outer peripheral surface of the conductive body not for driving.

Advantageous Effects of Invention

In the voice coil diaphragm according to the present invention, the wound parts are disposed in a manner where the separate but adjacent ones of the wound parts come into a partial contact with each other at least when vibrating, and the wound parts are each linked by the movable linking parts with other ones of the wound parts, or the wound parts are each joined intermittently in the winding direction with an adjacent one or more of the other wound parts by the joining parts. By this, while the stiffness of the entire voice coil diaphragm is kept low, even if forces in the width directions (the radial directions) are applied to the wound parts, each wound part becomes less likely to move because the adjacent one or more of the other wound parts prevent such a movement. Thus, each wound part becomes less likely to displace into the width directions. Therefore, the abnormal vibrations that occur mainly because of the width direction displacements of each conductive body are greatly reduced. In addition, since the stiffness of the entire voice coil diaphragm is low, the propagation of vibrations from each wound part to the other wound parts becomes reduced, thereby reducing the deterioration of the sound quality that occurs in the process of the propagation of the vibrations. Further, it is possible to reduce the phase-lag sound generated by the propagation of the vibrations and effectively prevent the generation of the natural vibration that can cause the divided vibrations.

As a result, it becomes possible with an electroacoustic transducer using the voice coil diaphragm according to the present invention to prevent deterioration of the sound and significantly improve the sound quality. Also, in the cases of the conductive part composed of a plurality of the conductive bodies arranged side by side so as to be in a planar shape, by connecting a plurality of the conductive bodies electrically in parallel, the cross-sectional area of each conductive body can be reduced while maintaining the predetermined impedance for the voice coil diaphragm. By adopting the conductive bodies having the small cross-sectional area in this way, the propagation of the vibrations is reduced inside each conductive body, and the sound quality as an electroacoustic transducer can be improved.

The voice coil diaphragm has the supporting body with which the movable linking parts are provided, the supporting body is disposed on one side of the coil body, and the movable linking parts each include a movable part, which faces the wound parts but is not joined with the wound parts, and two joined supporting parts, which are located one by one at both ends of the movable part and each joined with at least one of the wound parts. In this case, by simply joining the joined supporting parts of the supporting body with necessary points of the wound parts (the conductive body/bodies and the insulating part), it is possible to easily form the movable parts that are likely to vibrate independently without being restricted by the installation status of the wound parts. With the movable parts provided in this way, it is possible that the stiffness of the voice coil diaphragm becomes low, and the propagation of the vibrations from each wound part to the other wound parts is effectively reduced. Since the movable parts face the wound parts but are not joined with the wound parts and are movable, there is neither need to expand the area of the supporting body nor to reduce the area of the conductive part in order to secure the area for the movable parts. In addition, it is not necessary to widen the intervals between the wound parts. Therefore, the proportion of the conductive part can be increased to the maximum both in the volume of the voice coil diaphragm and in the sound radiating surface of the voice coil diaphragm. As a result, the conversion efficiency into sound when the voice coil diaphragm is used in a loudspeaker can be remarkably improved, and the sound quality can be improved.

When the joining parts are staggered with respect to the winding direction and the width directions of the wound parts, it is possible to provide the joining parts between all the wound parts adjacent to each other with respect to the width directions of the wound parts while maintaining the low stiffness of the voice coil diaphragm. Also, since the adjacent wound parts are securely fixed by the joining parts, the width direction displacements of each wound part that causes the abnormal vibrations are effectively suppressed, and further, even if a misalignment occurs in each wound part, the misalignment is prevented from spreading to other parts of the coil body. Thus, it is possible to effectively prevent the occurrence of obstacles such as a deformation of the entire voice coil diaphragm due to the misalignments. In particular, in the cases of the voice coil diaphragm used in a loudspeaker for reproducing the low-frequency range, not only the area is large but also the amplitude becomes large, and thus, the misalignment (i.e. the deformation) of the wound parts itself becomes likely to occur. However, by adopting the above structure, it is possible to prevent the occurrence of the above-mentioned obstacles by blocking the misalignments of the wound parts from occurring and spreading (expanding).

When the conductive part has a coating film on a part of or the whole of the conductive part, in addition to being able to prevent rust on the surface of the conductive part, it is possible to reduce the friction between each wound part and adjacent ones of the other wound parts during vibration by selecting the material for the coating film. Also, when linking each wound part and other ones of the wound parts by the movable linking parts, or when partially joining each wound part and an adjacent one or more of the other wound parts by the joining parts, the adhesive force of the adhesive or the like can be strengthened, thereby the durability and operational stability of the voice coil diaphragm can be improved.

When the conductive part is composed of a plurality of the conductive bodies arranged side by side, and the adjacent ones of the conductive bodies that have the insulating part therebetween are joined by the insulating part, the insulating part is protected by being sandwiched by the conductive bodies. Since the exposure of the insulating part to the surround (outside) accordingly decreases, there is less concern about peeling or chipping off of the insulating part even though the conductive bodies vibrate. Therefore, the insulating part can be formed extremely thin, which minimizes the influence of the insulating part affecting on the sound quality.

When the insulating part is composed of a conductive body not for driving and an insulating coating film for covering the outer peripheral surface of the conductive body not for driving, by adopting a thin insulating coating film, the mechanical properties of the insulating part and the conductive body/bodies become close to each other. Therefore, the entire coil body can be made to be uniform, and the entire coil body can be regarded as being composed of only the conductive part (the conductive body/bodies), which facilitates the design and handling of the voice coil diaphragm.

DESCRIPTION OF EMBODIMENTS

The embodiments of the present invention will be described next with reference to the accompanying drawings to provide an understanding of the present invention.

Figure 1A:
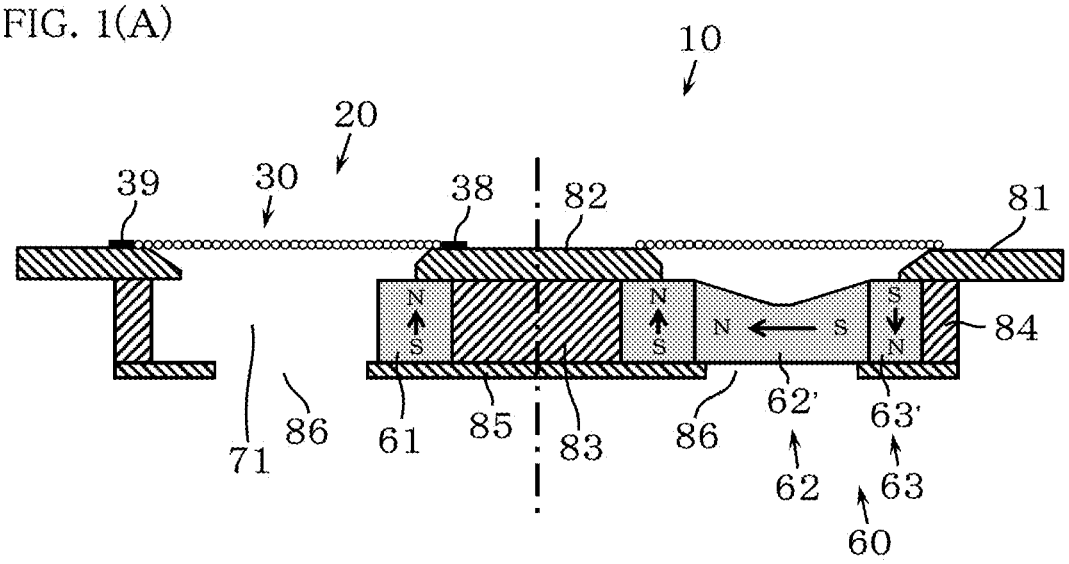
FIG. 1(A) is an end view of the main part of an electroacoustic transducer using the voice coil diaphragm according to a first embodiment of the present invention.

An electroacoustic transducer 10 shown in FIG. 1(A) is configured by disposing on the front side of a magnet plate 60, which will be mentioned later, a voice coil diaphragm 20 according to the first embodiment of the present invention so as to oppose the magnet plate 60. In here, the axial directions of the voice coil diaphragm 20 are the front-back directions of the electroacoustic transducer 10. The upward direction and the downward direction of FIG. 1(A) are the front side direction and the back side direction, respectively of the electroacoustic transducer 10 (the voice coil diaphragm 20), whereas the leftward direction and the rightward direction of FIG. 1(A) are the width directions (the radial directions) of the electroacoustic transducer 10 (the voice coil diaphragm 20) (The same is also applicable in FIGS. 3, 4, 6, 8, 9, 12, 16, and 17 below). The electroacoustic transducer 10 using the voice coil diaphragm 20 according to this embodiment is suitable as a loudspeaker capable of reproducing to the low-frequency range.

Figure 2:
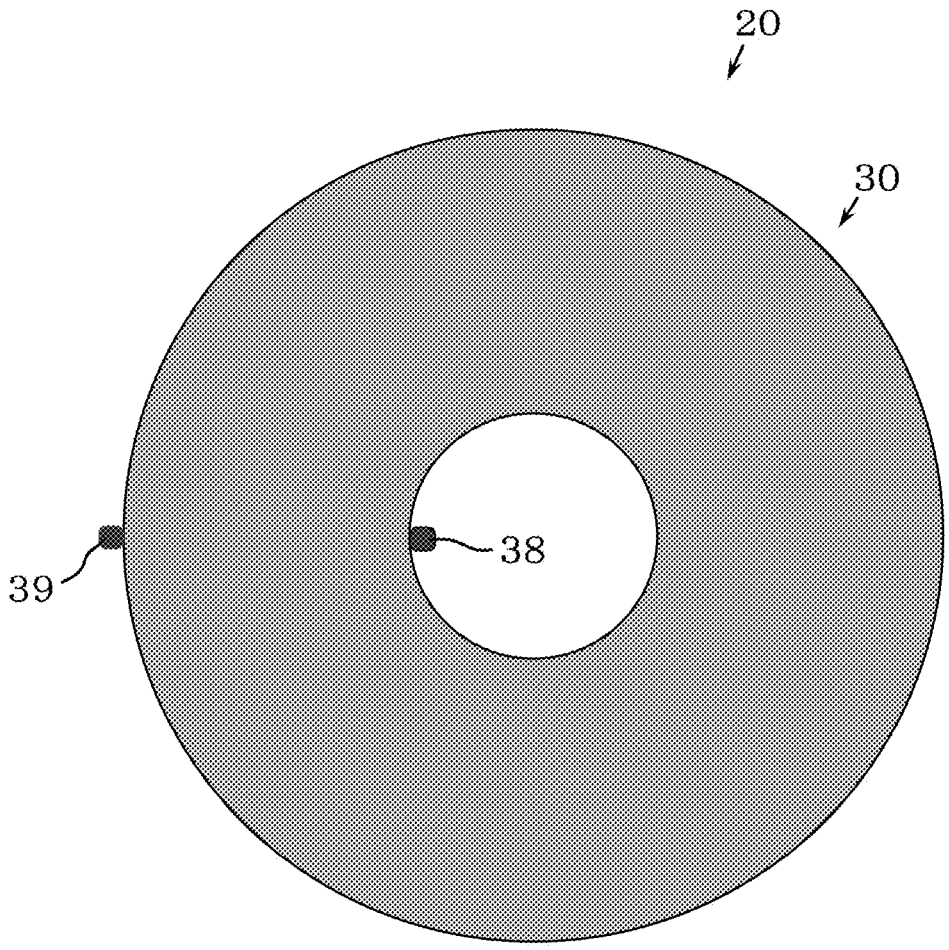
FIG. 2 is a plan view of the same voice coil diaphragm.
Figure 3:
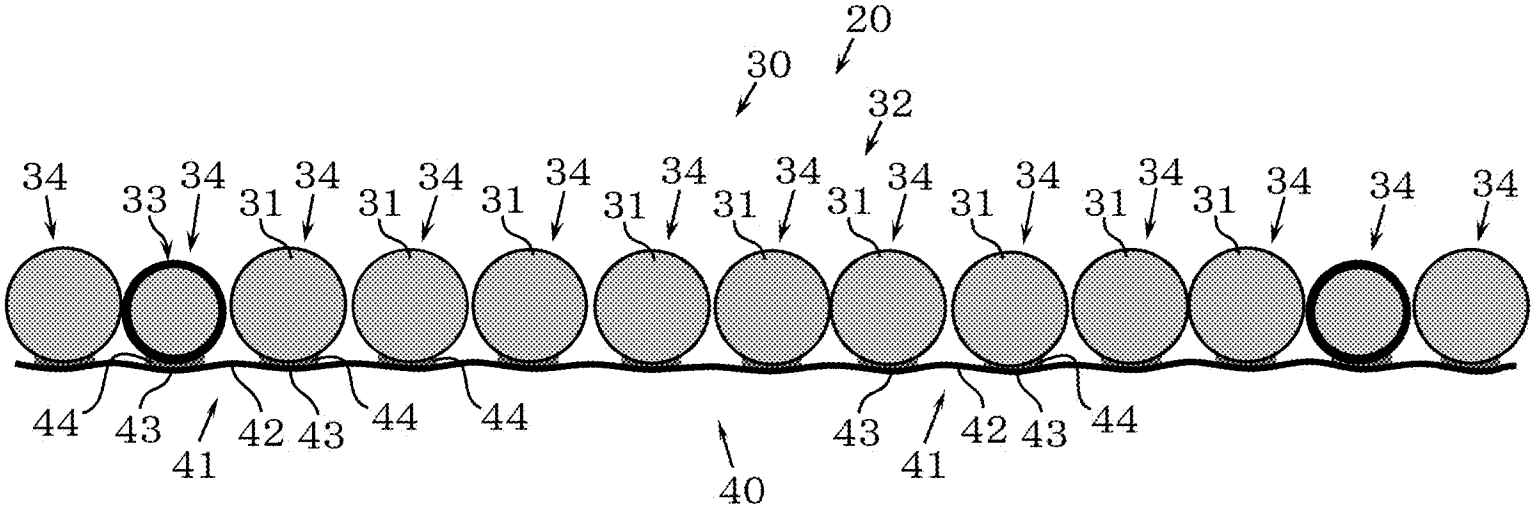
FIG. 3 is an end view of the main part showing a part of the same voice coil diaphragm cut in a radial direction.

The voice coil diaphragm 20 includes a coil body 30 formed in a planar annular (ring-like) shape as shown in FIG. 2. The coil body 30 is configured, as shown in FIG. 3, by forming a spiral winding state with a conductive part 32, which is composed of a plurality of (nine, in this embodiment) conductive bodies 31 arranged side by side so as to be in a planar shape and electrically connected in parallel, and an insulating part 33. By forming this spiral winding state, the coil body 30 becomes to have a plurality of wound parts 34, which are arranged side by side and separated from each other between the inner circumference and the outer circumference of the coil body 30. Accordingly, each wound part 34 is composed of one of the conductive bodies 31 or the insulating part 33. In here, the insulating part 33 is arranged side by side with the conductive part 32. Since all the conductive bodies 31 adjacent in the width directions in the conductive part 32 are electrically connected in parallel, there is no need to insulate the adjacent conductive bodies 31 from each other. By this, the adjacent conductive bodies 31 can be disposed in contact with each other or disposed with minute gaps between them. As described above, each wound part 34 (each conductive body 31 or the insulating part 33) is arranged so as to come into a partial contact with an adjacent one or more of the other wound parts 34 at least when vibration.

As shown in FIGS. 1(A) and 2, an inner peripheral side terminal 38 is electrically connected to the inner peripheral side end of the nine conductive bodies 31 arranged side by side, while an outer peripheral side terminal 39 is connected to the outer peripheral side end. In this embodiment, the inner diameter of the coil body 30 is 40 mm and the outer diameter of the coil body 30 is 140 mm. As each conductive body 31, a copper-clad aluminum wire with a cross-section having a diameter of 100 μm that is formed in a circular shape is used. Also in this embodiment, as the insulating part 33, a copper-clad aluminum wire with a cross-section having a diameter of 80 μm that is formed in a circular shape is used, and the outer peripheral surface of which is covered with a polyurethane insulating coating film with a thickness of 6 μm. Then, the nine conductive bodies 31 and the insulating part 33 are spirally wound side by side together, and by connecting the nine conductive bodies 31 electrically in parallel, the impedance of the voice coil diaphragm 20 is made to be approximately 5Ω. The sound quality as a loudspeaker becomes better when the cross-sectional area of each conductive body 31 gets smaller, and by increasing the number of the conductive bodies 31 electrically connected in parallel as described in this embodiment, it is possible to reduce the cross-sectional area of each conductive body 31 while maintaining a predetermined impedance as the voice coil diaphragm 20. Reducing the propagation of the vibrations in each conductive body 31 in this way makes it possible to improve the sound quality in the cases of using the voice coil diaphragm 20 in a loudspeaker.

As shown in FIG. 3, the voice coil diaphragm 20 has a thin-film supporting body 40 that is disposed on one side of the coil body 30 (the lower side in FIG. 3, the back side of the voice coil diaphragm 20) and covers the entire surface of the back side of the coil body 30. In the supporting body 40, movable linking parts 41, which link each wound part 34 and other ones of the wound parts 34, are provided. Each movable linking part 41 includes a movable part 42, which faces the wound parts 34 but is not joined with the wound parts 34, and two joined supporting parts 43, which are located one by one at both ends of the movable part 42 and each joined with one of the wound parts 34. As the material for the supporting body 40, e.g., a silicone resin is used, and each wound part 34 is joined with one of the joined supporting parts 43 by using a mutual joining part 44 made of a silicone resin.

Figure 1B:
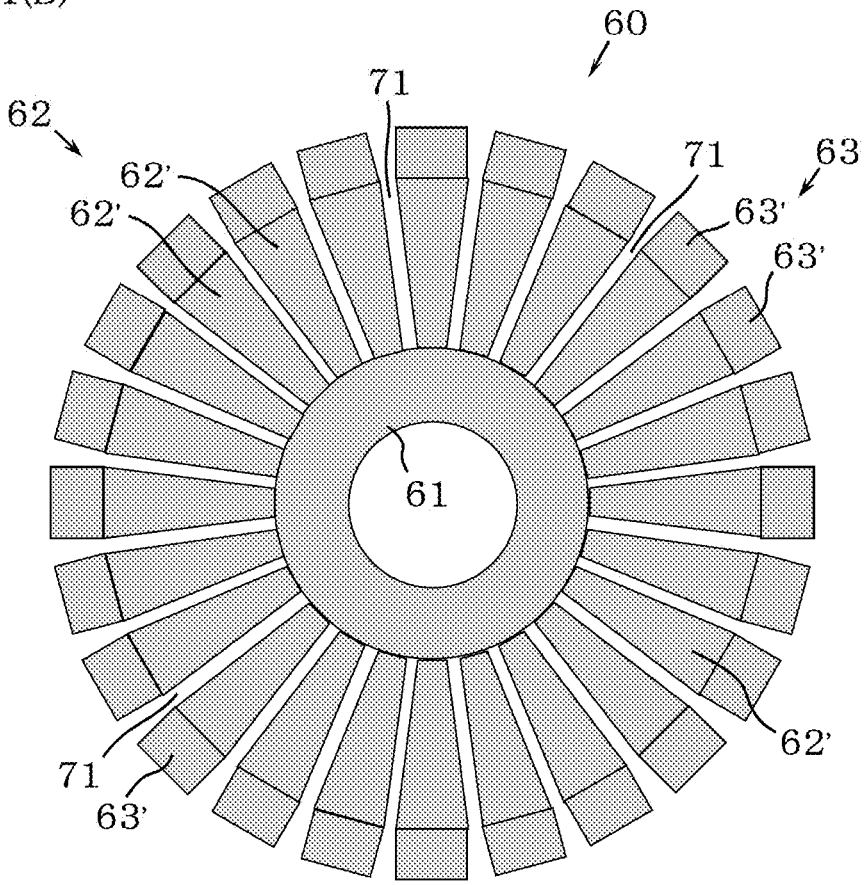
FIG. 1(B) is a rear view of the magnet plate in the electroacoustic transducer using the same voice coil diaphragm.

Subsequently, the magnet plate 60 that is used in combination with the voice coil diaphragm 20 is explained. As shown in FIGS. 1(A) and 1(B), a central region magnet 61 made of a cylindrical neodymium magnet is arranged in the central region of the magnet plate 60. The dimensions of the central region magnet 61 are, e.g., the outer diameter: 60 mm, the inner diameter: 32 mm, and the thickness (the axial direction length): 16 mm. Along the outer periphery of this central region magnet 61, basic region magnets 62 are arranged. The basic region magnets 62 are composed of small magnets 62', the number of which is 24 in total, each made of a neodymium magnet. The small magnets 62' are each formed into a trapezoidal shape when viewed from above in which the inner peripheral side (the side of the central region magnet 61) is the upper bottom and the outer peripheral side is the lower bottom, and are arranged radially around (i.e. along the outer circumference of) the central region magnet 61. When vibrating, the voice coil diaphragm 20 formed in an annular (ring-like) shape deforms into a wavy shape in which the maximum displacement (amplitude) occurs at an intermediate position between the inner peripheral side end and the outer peripheral side end. In light of this, a recess is provided on the upper surface of each small magnet 62' according to the shape of the voice coil diaphragm 20 during vibration so that the voice coil diaphragm 20 and the basic region magnets 62 do not contact (interfere with) each other when vibrating. When viewed from above, each small magnet 62' is in a trapezoidal shape with the dimensions of, e.g., the upper bottom: 4.4 mm, the lower bottom: 14 mm, and the height (the radial direction length): 33 mm, and the maximum thickness (the axial direction length) of each small magnet 62' is 16 mm.

Around (i.e. along the outer periphery of) the basic region magnets 62 of the magnet plate 60, outer peripheral region magnets 63 are arranged. The outer peripheral region magnets 63 are composed of small magnets 63', the number of which is 24 in total, radially arranged around (i.e. along the outer periphery of) the basic region magnets 62. Each small magnet 63' is made of a neodymium magnet formed in a rectangular parallelepiped shape. When viewed from above, each small magnet 63' is in a rectangular shape with the dimensions of, e.g., the height (the radial direction length): 10 mm, and the width (the circumferential direction length): 14 mm, and the thickness (the axial direction length) of each small magnet 63' is 16 mm. Between the small magnets 62' of the basic region magnets 62 adjacent to each other in the circumferential direction and between the small magnets 63' of the outer peripheral region magnets 63 adjacent to each other in the circumferential direction, openings (gaps) each serving as a sound passage hole 71 are formed. In here, the distance between the voice coil diaphragm 20 and the magnet plate 60 is set to 6 mm at a narrowest part.

In FIG. 1(A), for convenience of explanation, the right side of the center line shows the cross-sectional surface cut at a position passing through one of the small magnets 62', whereas the left side of the center line shows the cross-sectional surface cut at a position passing through one of the sound passage holes 71. Note that the shape and the dimensions of each part of the magnet plate are not limited to this embodiment, but may be appropriately selected.

On the front side of the electroacoustic transducer 10, as shown in FIG. 1(A), a main frame 81 made of a nonmagnetic material and supporting the outer peripheral portion of the voice coil diaphragm 20 from the back side is disposed. Additionally, on the front side of the central region magnet 61, a front frame 82 made of a nonmagnetic material into a circular-plate shape for supporting the inner peripheral portion of the voice coil diaphragm 20 from the back side, is disposed, and into the central hole of the central region magnet 61, a central frame 83 made of a nonmagnetic material into a columnar shape is inserted. Further, along the outer periphery of the outer peripheral region magnets 63, an outer peripheral frame 84 made of a nonmagnetic material into a cylindrical shape is disposed, and behind the magnet plate 60, a back frame 85 made of a nonmagnetic material is disposed. In the back frame 85, sound passage holes 86 are formed, and these sound passage holes 86 serve to emit the sound of the back side of the voice coil diaphragm 20 to the outside of the electroacoustic transducer 10 by communicating with the sound passage holes 71. As shown in FIG. 1(A), the central region magnet 61 is magnetized in the front side direction of the axial directions of the magnet plate 60.

The basic region magnets 62 (the small magnets 62') are magnetized in the center-toward direction of the radial directions of the magnet plate 60. The outer peripheral region magnets 63 (the small magnets 63') are magnetized in the back side direction of the axial directions of the magnet plate 60.

Since a magnetic force that pushes the central region magnet 61 forward acts, the central magnet 61 is fixed by being sandwiched between the front frame 82 and the back frame 85. Also, since a magnetic force that pushes the outer peripheral region magnets 63 forward acts, the outer peripheral region magnets 63 are fixed by being sandwiched between the main frame 81 and the back frame 85. Between the front frame 82 and the central frame 83, between the central frame 83 and the back frame 85, between the main frame 81 and the outer peripheral frame 84, and between the outer peripheral frame 84 and the back frame 85, are each bonded. However, if the above-mentioned magnetic forces are too strong and the bonding force is insufficient, the use of bolts or the like is recommended. Regarding the small magnets 62' composing the basic region magnets 62, a magnetic force that strongly pushes them to the back frame 85 acts and the small magnets 62' are fixed, and so, any special means for fixing them is not used. Incidentally, in light of the fact that the small magnets 62' are pushed against the back frame 85, the sound passage holes 86, which are a plurality of openings provided in the back frame 85, are each designed in a shape and a size not allowing the small magnets 62' to fall out to the back side.

Hereinafter, the operation of the electroacoustic transducer 10 using the voice coil diaphragm 20 will be described.

With respect to the annular coil body 30, a magnetic field in the radial directions is created by the magnet plate 60. Then, an electromagnetic force is generated in each conductive body 31 of the spirally wound conductive part 32 by supplying an acoustic signal current from the inner peripheral side terminal 38 and the outer peripheral side terminal 39 to each conductive body 31. Of the magnetic field created by the magnet plate 60, a magnetic field component parallel to the surface of the voice coil diaphragm 20 vibrates the voice coil diaphragm 20 in the front-back directions and generates sound. At this time, if the mechanical properties of the conductive bodies 31 and the insulating part 33 are significantly different, the movable linking parts 41 may be torn and/or the mutual joining parts 44 joining the insulating part 33 with the joined supporting parts 43 may be peeled off when the conductive bodies 31 vibrate, which may result in damaging the voice coil diaphragm 20. In light of this, in order to bring the mechanical properties of the insulating part 33 close to those of the conductive bodies 31, a conductive body not for driving made of the same material as the conductive bodies 31 and covered with a thin insulating coating film, is used as the insulating part 33, as was mentioned above. By matching the mechanical properties of the wound parts 34 in the coil body 30 in this way, damage to the voice coil diaphragm 20 can be prevented. In particular, since the amplitude of the voice coil diaphragm 20 becomes large in a loudspeaker that reproduces to the low-frequency range, making the mechanical properties (of the wound parts 34) in the coil body 30 be uniform is effective. Incidentally, no acoustic signal current is applied to the insulating part 33 in consideration of the influence of the insulating coating film on the sound quality.

In the voice coil diaphragm 20, each wound part easily vibrates in an independent way because the stiffness of the movable linking parts 41 (the movable parts 42) is low. Accordingly, differences in the front-back direction displacements occur between adjacent ones of the wound parts 34 due to the vibration. If the differences in the front-back direction displacements occur between adjacent ones of the wound parts 34 and they come into contact with each other, it becomes difficult for the wound parts 34 to return to the original positions because of the friction, which can cause the misalignments. Particularly, in the cases of the voice coil diaphragm 20 for a loudspeaker capable of reproducing to the low-frequency range, the amplitude is large and the deformation in a wavy shape becomes large. In such a case, the differences in the front-back direction displacements between the adjacent wound parts 34 also become large and it can lead to a situation where each wound part 34 cannot return to the predetermined position. To cope with this, in this embodiment, a gap of approximately 6 μm that is to be a play is provided between each wound part 34 so that it becomes easier for each wound part 34 to go back to the predetermined (original) position. Although the size of the gap is determined within a range in which each wound part 34 can vibrate while coming into a partial contact with an adjacent one or more of the other wound parts 34 at least when vibrating, the size can be appropriately selected according to the diameter, the amplitude, and the like of each wound part 34, and it does not necessarily have to be uniform.

In the voice coil diaphragm 20 configured in this way, even if forces in the width directions are applied to the wound parts 34, each wound part 34 comes into contact with an adjacent one or more of the other wound parts 34, thereby being kept from moving into the width directions. Therefore, although the stiffness of the entire voice coil diaphragm 20 is low, the width direction displacements, which have been a problem with the conventional voice coil diaphragms, are hard to occur. This function of preventing the width direction displacements makes it possible to significantly reduce the abnormal vibrations generated mainly due to the width direction displacements of the wound parts 34.

In order for the voice coil diaphragm 20 to effectively function as a diaphragm, it is necessary to block air flow between the front side and the back side of the voice coil diaphragm 20. Since the voice coil diaphragm 20 capable of reproducing to the low-frequency range has the large amplitude and the differences in the front-back direction displacements between the adjacent wound parts 34 become large, gaps become generated between the adjacent wound parts 34. However, by the film-like supporting body 40 disposed on the back side of the voice coil diaphragm 20, the air flow is reliably blocked.

Further, not joining the movable part 42 of each movable linking part 41 with the wound parts 34 makes it possible for each wound part 34 to easily vibrate (move) in an independent way. In this way, the stiffness of the entire voice coil diaphragm 20 can be significantly reduced in spite of the winding state having a space with which the adjacent wound parts 34 can come into contact with each other, thereby achieving unprecedented high quality sound. In order to improve the sound quality, it is preferred to reduce the stiffness of the movable linking parts 41 (the movable parts 42). However, when properly setting the stiffness of the movable linking parts 41, the length of each movable part 42 (i.e. the distance between the adjacent joined supporting parts 43), the thickness, and the hardness of each movable part 42 can be appropriately selected. Also in order to improve the sound quality, it is preferred that the mass and the volume of substances other than the conductive bodies 31 that is the driving part, be as small as possible, and the thickness of each movable linking part 41 (the supporting body 40) be as thin as possible.

Further, when the amplitude of the voice coil diaphragm 20 is large, the differences in the front-back direction displacements occurring between the adjacent wound parts 34 become large. In order to maintain the low stiffness of the supporting body 40 even in such cases, each movable part 42 needs to have a sufficient length. In order to satisfy these conditions, in this embodiment, a half of the radial direction length of the supporting body 40 is secured and allocated to the length of the movable parts 42 as shown in FIG. 3. That is, the ratio occupied by the movable parts 42 and the joined supporting parts 43 to the supporting body 40 are set to 50% each. The supporting body 40 is made of a silicone film that has a shore hardness HS (measured in accordance with JIS B7727) of approximately 15, and a thickness of 8 μm. The mutual joining parts 44 having an only function of joining the joined supporting parts 43 with the wound parts 34 fall into substances other than the driving part, and so, in order to improve the sound quality, it is preferred to reduce the use of the mutual joining parts 44 as much as possible within a scope where the joining does not come off. Thus, in the cases where a same silicone resin is used as the material for both the supporting body 40 and the mutual joining parts 44, it is not necessary to separately provide the mutual joining parts 44 as long as the supporting body 40 can be formed to be directly joined with the wound parts 34.

As described above, the voice coil diaphragm 20 reduces the propagation of the vibrations from each conductive body 31 to the other conductive bodies 31 or to the insulating part 33, and achieves a great improvement in sound quality. Further, even if the amplitude of the voice coil diaphragm 20 becomes increased for reproducing the low-frequency range, the deterioration of the sound quality is prevented by maintaining the low stiffness, and also, tearing of the supporting body 40 is less likely to occur. Adopting this voice coil diaphragm 20 makes it possible that the electroacoustic transducer 10 makes the best use of the original feature of the voice coil diaphragm of emitting sound directly from the conductive bodies. In this embodiment, the magnet plate 60 is configured by combining the three kinds of magnets of the central region magnet 61, the basic region magnets 62, and the outer peripheral region magnets 63. It should be noted, however, that the configuration of the magnet plate is not limited to this and can be selected as appropriate. Also, in the cases of changing the size of each part of the electroacoustic transducer and using it as a microphone, the voice coil diaphragm needs to be adapted to vibrate by receiving sound. This makes the conductive bodies generate an electromotive force, and the electromotive force can be extracted from the inner peripheral side terminal and the outer peripheral side terminal as an acoustic signal current.

A voice coil diaphragm 20A according to the second embodiment of the present invention will be explained next. Any components in common with the first embodiment are given the same reference signs and omitted from the explanation.

Figure 4:
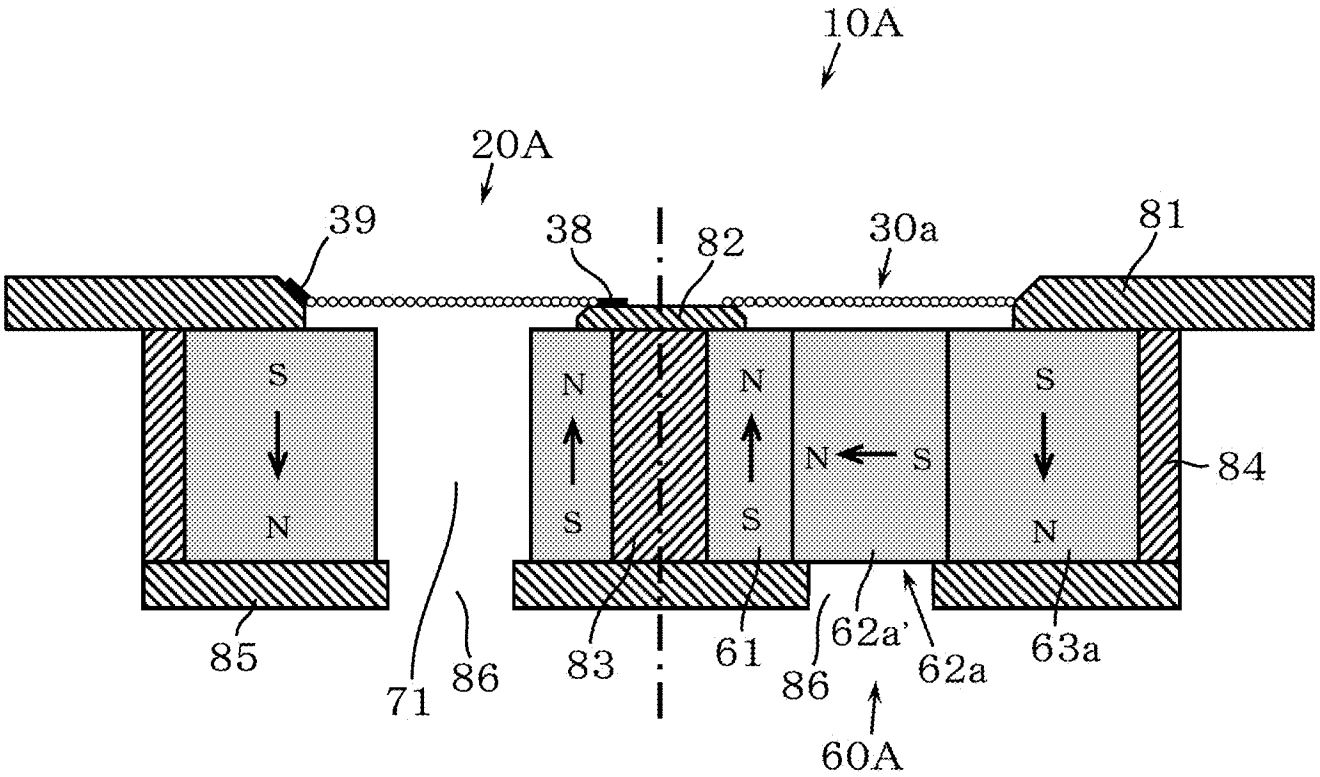
FIG. 4 is an end view of the main part of an electroacoustic transducer using the voice coil diaphragm according to a second embodiment of the present invention.

FIG. 4 shows an electroacoustic transducer 10A, in which the voice coil diaphragm 20A according to the second embodiment of the present invention is disposed on the front side of a magnet plate 60A so as to oppose the magnet plate 60A.

Figure 5:
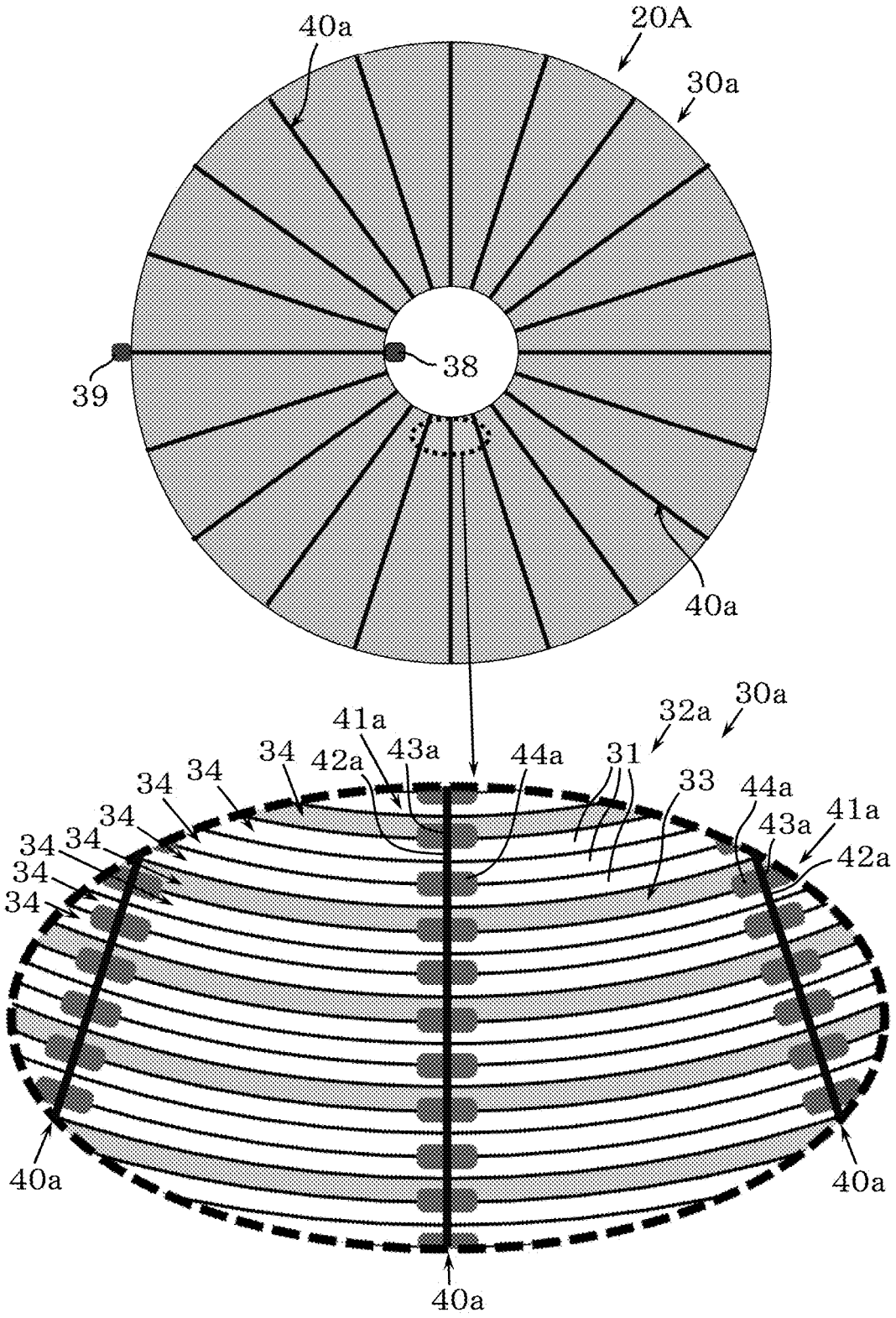
FIG. 5 is a rear view of the same voice coil diaphragm.
Figure 6:
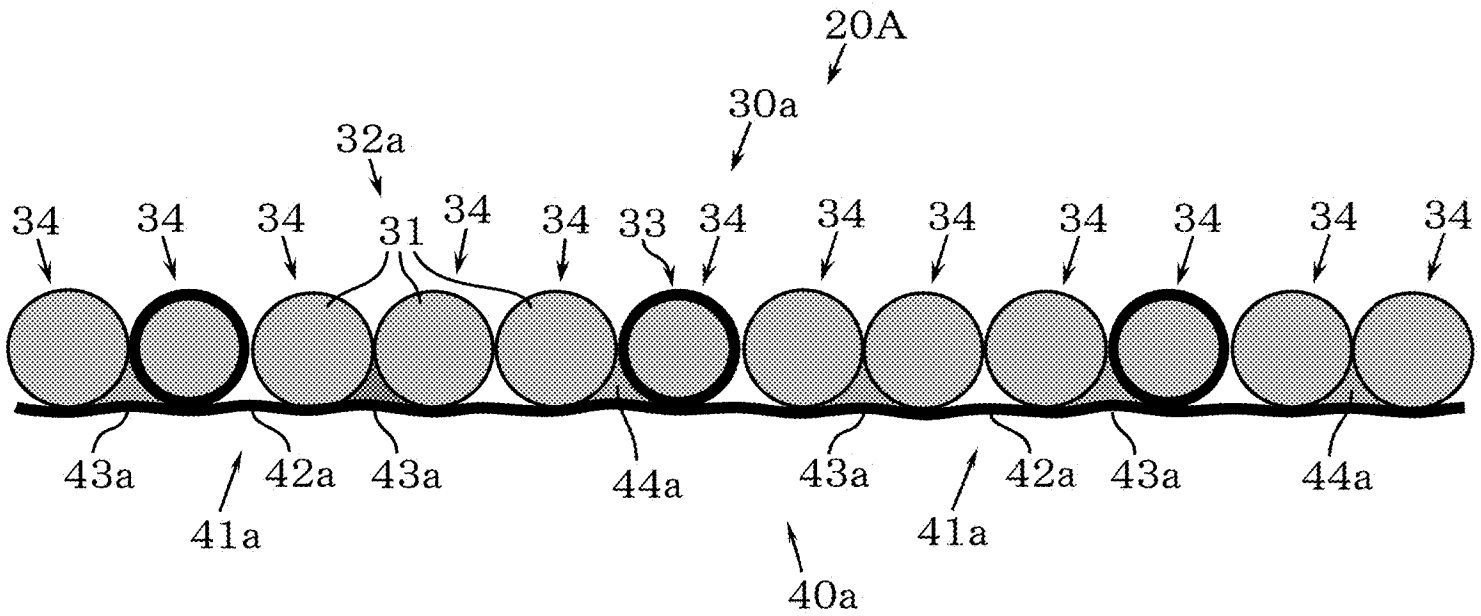
FIG. 6 is an end view of the main part showing a part of the same voice coil diaphragm cut in a radial direction at a position passing through one of supporting bodies.

The voice coil diaphragm 20A differs from the first embodiment, as shown in FIGS. 5 and 6, in that a conductive part 32*a* composing a coil body 30*a* is formed by three conductive bodies 31 arranged side by side and electrically connected in parallel, and in that a plurality of (in this embodiment, 20 of) string-state (line-state) supporting bodies 40*a* are radially arranged at an equal angle interval instead of the film-like supporting body 40. The magnet plate 60A used in combination with the voice coil diaphragm 20A differs from the magnet plate 60 in that the upper surface of each of small magnets 62*a*' composing basic region magnets 62*a* is formed to be flat, and in that an outer peripheral region magnet 63*a* is formed by using one neodymium magnet into a cylindrical shape.

In FIG. 4, for convenience of explanation, the right side of the center line shows the cross-sectional surface cut at a position passing through one of the small magnets 62*a*', whereas the left side of the center line shows the cross-sectional surface cut at a position passing through one of the sound passage holes 71.

Each supporting body 40*a* includes movable linking parts 41*a* that links each wound part 34 with other ones of the wound parts 34, as shown in FIGS. 5 and 6. The movable linking parts 41*a* each includes a movable part 42*a*, which faces the wound parts 34 but is not joined with the wound parts 34, and two joined supporting parts 43*a*, which are located one by one at both ends of the movable part 42*a* and each joined with two of the wound parts 34. In here, the joined supporting parts 43*a* are each joined with the wound parts 34 by a mutual joining part 44*a* made of a silicone resin. The mutual joining part 44*a* also serves as a joining part that partially join the two adjacent ones of the wound parts 34 as shown in FIG. 6. In other words, to the grooves (gaps) formed between two adjacent ones of the wound parts 34, the mutual joining parts 44*a* are provided intermittently in the winding direction of the wound parts 34, thereby the two adjacent wound parts 34 are joined with the supporting body 40*a* (the joined supporting parts 43*a*). By partially joining two adjacent ones of the wound parts 34 using the mutual joining parts 44*a* in this way, the propagation of the vibrations between the two adjacent wound parts 34 is reduced. Further, by the configuration where the joined supporting parts 43*a* are securely joined with the wound parts 34 by using the mutual joining parts 44*a* and also two adjacent ones of the wound parts 34 are securely joined with each other by using the mutual joining parts 44*a*, each wound part 34 is allowed to independently (freely) vibrate in the front-back directions thanks to the movable part 42*a*, and at least when vibrating, each wound part 34 comes into contact with an adjacent one or more of the other wound parts 34, and thus, the wound parts 34 are blocked from moving in the width directions. Therefore, the same actions and effects as in the first embodiment can be obtained.

The voice coil diaphragm 20A is suitably used for a mid-frequency range loudspeaker, a high-frequency range loudspeaker, or a microphone. Since the amplitude does not become large in these cases unlike the voice coil diaphragm 20, the differences in the front-back direction displacements between the adjacent wound parts 34 also do not become large. Accordingly, in the voice coil diaphragm 20A, when the wound parts 34 vibrate, the gaps generated between the adjacent wound parts 34 are also small. Therefore, in this embodiment, the string-like supporting bodies 40*a* can be used instead of the film-like supporting body. Moreover, since the differences in the front-back direction displacements between the adjacent wound parts 34 do not become large, the gap (play) provided when forming the coil body 30*a* between each wound part 34 and an adjacent one or more of the other wound parts 34, can be made small. This makes it possible to improve the blocking effect of the air flow between the adjacent ones of the wound parts 34.

Regarding parts other than the conductive bodies 31, such as the supporting bodies 40*a* and the mutual joining parts 44*a*, in order to improve the sound quality, it is preferred to reduce the mass and the volume as much as possible and to minimize the area coming into contact with the conductive bodies 31. The string-like supporting bodies 40*a* as in this embodiment have an area and a volume that are smaller, as a whole, than the film-like supporting body 40, and thus, the total area where the conductive bodies 31 come into contact with the supporting bodies 40*a* via the mutual joining parts 44*a* becomes small, thereby it is advantageous in terms of sound quality. Instead of a plurality of the string-like (line-like) supporting bodies 40*a*, a supporting body formed into a net shape in advance may be used. Also, instead of the string-like (line-like) supporting bodies 40*a* as in this embodiment, band-like supporting bodies may be used. However, when a plurality of the supporting bodies are arranged radially as in this embodiment, the arranging intervals of the supporting bodies are narrower on the inner peripheral side than on the outer peripheral side, and thus, when the voice coil diaphragm 20A is viewed as a whole, the stiffness on the inner peripheral side is higher than that on the outer peripheral side. In this case, by using trapezoidal supporting bodies each having a narrower inner peripheral width and a wider outer peripheral width, the entire stiffness of the voice coil diaphragm 20A can be made uniform. Incidentally, since the amplitude of the voice coil diaphragm 20A does not become large when vibrating as was mentioned above, even if a recess is provided on the upper surface of each basic region magnet 62*a* (each small magnet 62*a*') in accordance with the amplitude, the recess becomes extremely shallow. Accordingly, the upper surface of each basic region magnet 62*a* (each small magnet 62*a*') is formed to be flat in consideration of ease of manufacturing.

A modification of the voice coil diaphragm according to the second embodiment of the present invention will be explained next. Any components in common with the first or second embodiment are given the same reference signs and omitted from the explanation.

Figure 7:
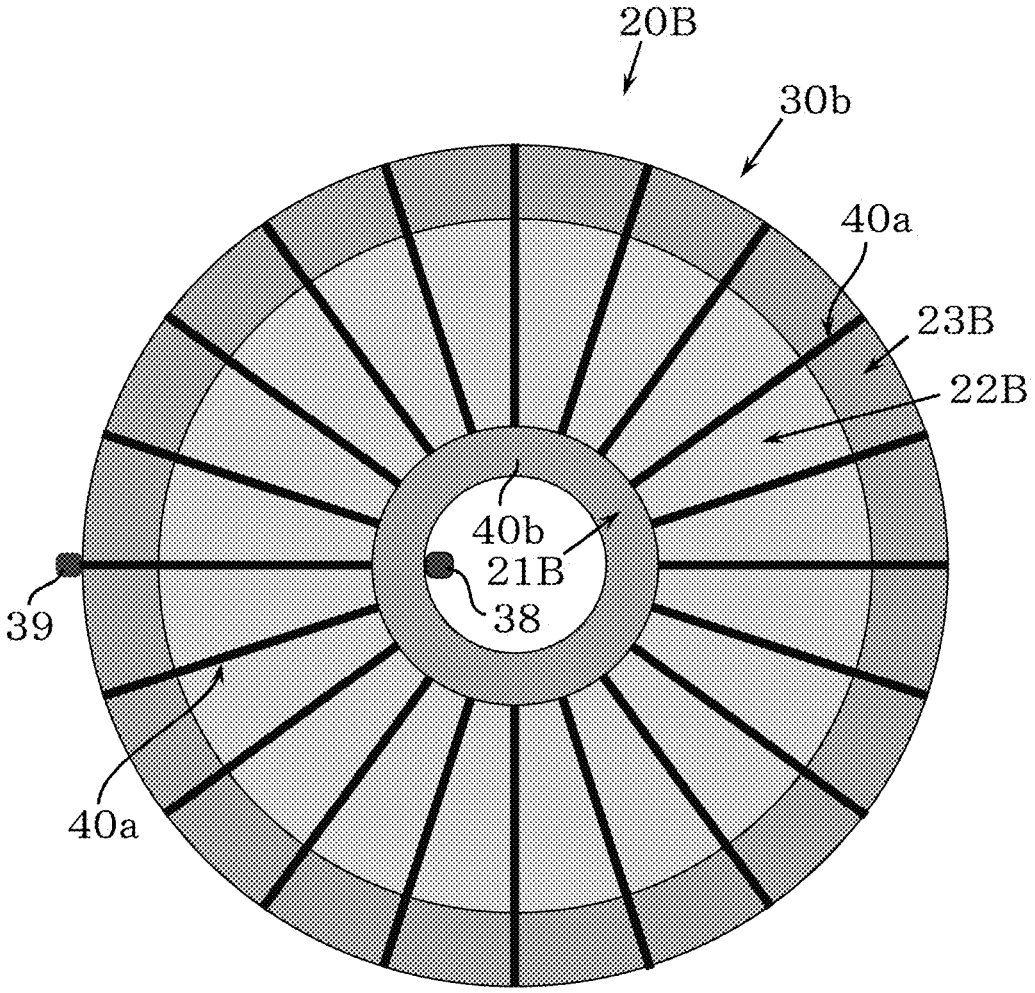
FIG. 7 is a rear view showing a first modification of the same voice coil diaphragm.
Figure 8:
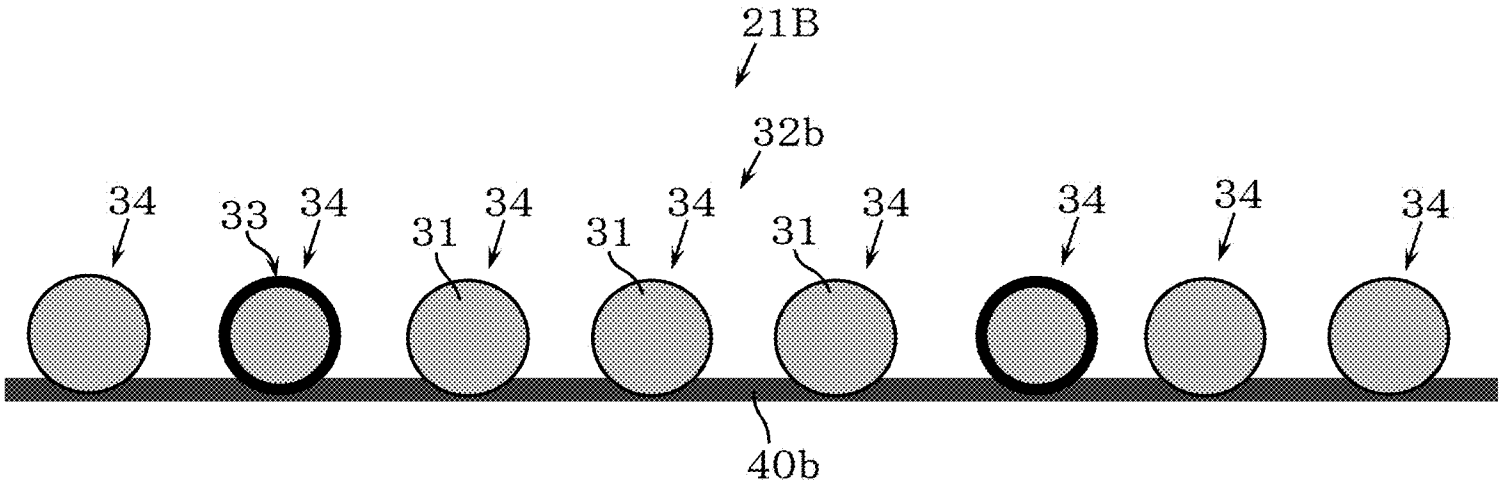
FIG. 8 is an end view of the main part showing a part of an inner peripheral side buffer part of the same modification cut in a radial direction.
Figure 9:
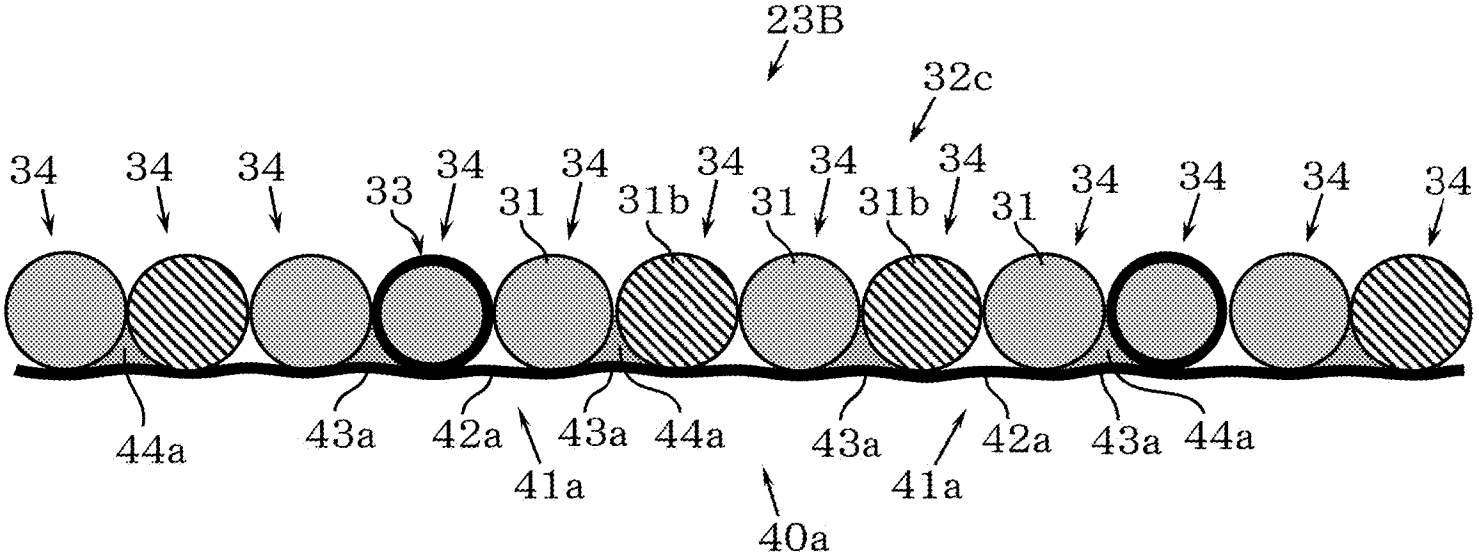
FIG. 9 is an end view of the main part showing a part of an outer peripheral side buffer part of the same modification cut in a radial direction at a position passing through one of supporting bodies.

In FIG. 4 explained above, it is known that the strength of the magnetic field, which is created by the magnet plate 60A and drives the conductive bodies 31, rapidly reduces on the inner peripheral side and the outer peripheral side of the voice coil diaphragm 20A. In light of this, by setting the current density in the inner peripheral side and the outer peripheral side regions, where the magnetic field strength is low, lower than the current density in the other (intermediate portion) region, where the magnetic field strength is high, the conversion efficiency to sound can be improved. FIGS. 7 to 9 show a voice coil diaphragm 20B of the first modification corresponding to this. The voice coil diaphragm 20B differs from the voice coil diaphragm 20A in that a coil body 30*b*, which is composed of three part: an inner peripheral side buffer part 21B, a main vibrating part 22B, and an outer peripheral side buffer part 23B, is used, and in that a film-like supporting body 40*b* is provided with respect to the inner peripheral side buffer part 21B instead of the string-like supporting bodies 40*a*. The inner peripheral side buffer part 21B and the outer peripheral side buffer part 23B also have the function as the buffer parts to the vibrations of the main vibrating part 22B on the inner peripheral side and the outer peripheral side of the voice coil diaphragm 20B.

Figure 18:
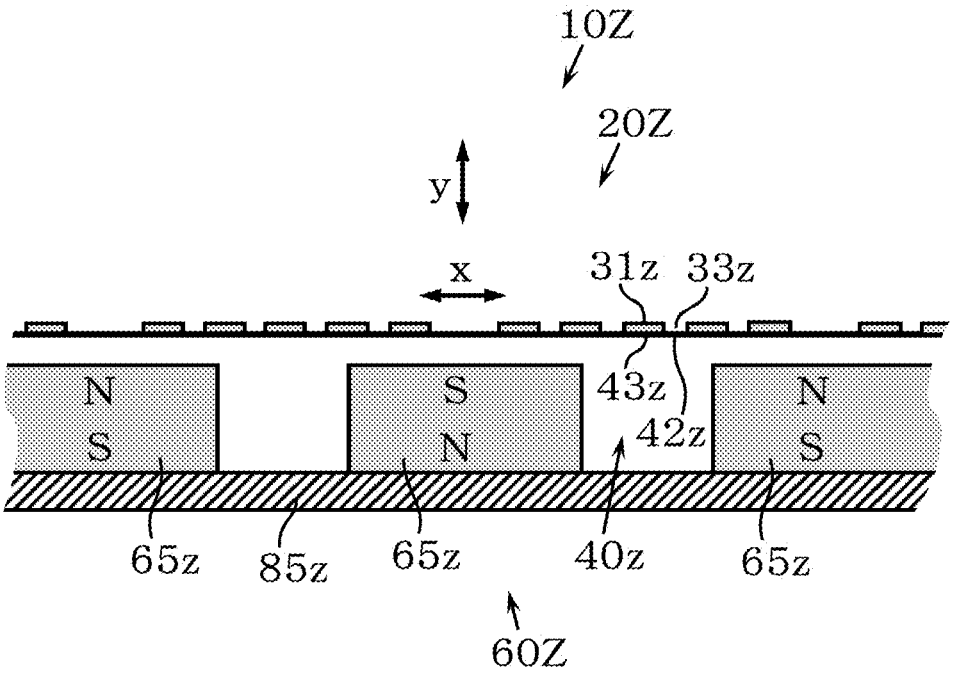
FIG. 18 PRIOR ART
FIG. 18 is an end view of the main part showing a part of a loudspeaker using a voice coil diaphragm of a conventional example and also showing its operating principle.

In the inner peripheral side buffer part 21B, as shown in FIG. 8, the arranging intervals of the three conductive bodies 31, which compose the conductive part 32*b*, and the insulating part 33 are made wider than the coil body 30*a* (see FIG. 6) in order to reduce the density of the conductive bodies 31 and also the current density in the conductive part 32*b*. The configuration as in the inner peripheral side buffer part 21B, in which the arranging intervals of the wound parts 34 (the conductive bodies 31 and the insulating part 33) are widened, can become a factor causing the width direction displacements as same as the conventional example shown in FIG. 18, however, the area of the inner peripheral side buffer part 21B is small, and thus, there is almost no influence from it. Nevertheless, if adopting the configuration same as the inner peripheral side buffer part 21B also for the outer peripheral side buffer part 23B, the displacements in the width directions occur in the entire main vibrating part 22B and the abnormal vibrations become likely to occur. So, as shown in FIG. 9, in the outer peripheral side buffer part 23B, additional conductive bodies 31*b* made of the same material as the conductive bodies 31 and having the same diameter as the conductive bodies 31 are additionally provided one for each in between the three conductive bodies 31, and the additional conductive bodies 31*b* are electrically connected in parallel with the conductive bodies 31 to compose the conductive part 32*c*. This increases the cross-sectional area of the conductive part 32*c*, and accordingly, reduces the current density. That is, in the outer peripheral side buffer part 23B, by arranging the conductive bodies 31, the additional conductive bodies 31*b*, and the insulating part 33 in a manner where they are in close contact with each other, not only the current density is reduced, but also the occurrence of the width direction displacements in the wound parts 34 (the conductive bodies 31, the additional conductive bodies 31*b*, and the insulating part 33) is prevented. Since the configuration of the main vibrating part 22B is the same as the coil body 30*a* (see FIG. 6), the explanation is omitted.

In the case of the voice coil diaphragm 20A, by radially arranging a plurality of the supporting bodies 40*a*, the arranging intervals of the supporting bodies 40*a* are narrower on the inner peripheral side than the outer peripheral side, and thus, when the voice coil diaphragm 20A is viewed as a whole, the stiffness on the inner peripheral side is higher than that on the outer peripheral side. To cope with this, in the voice coil diaphragm 20B, a thin-film supporting body 40*b* having a low stiffness is provided with respect to the inner peripheral side buffer part 21B instead of the supporting bodies 40*a*, thereby making the entire stiffness of the voice coil diaphragm 20B be uniform and blocking the air flow between the wound parts 34 having the widened arranging intervals.

Figure 10:
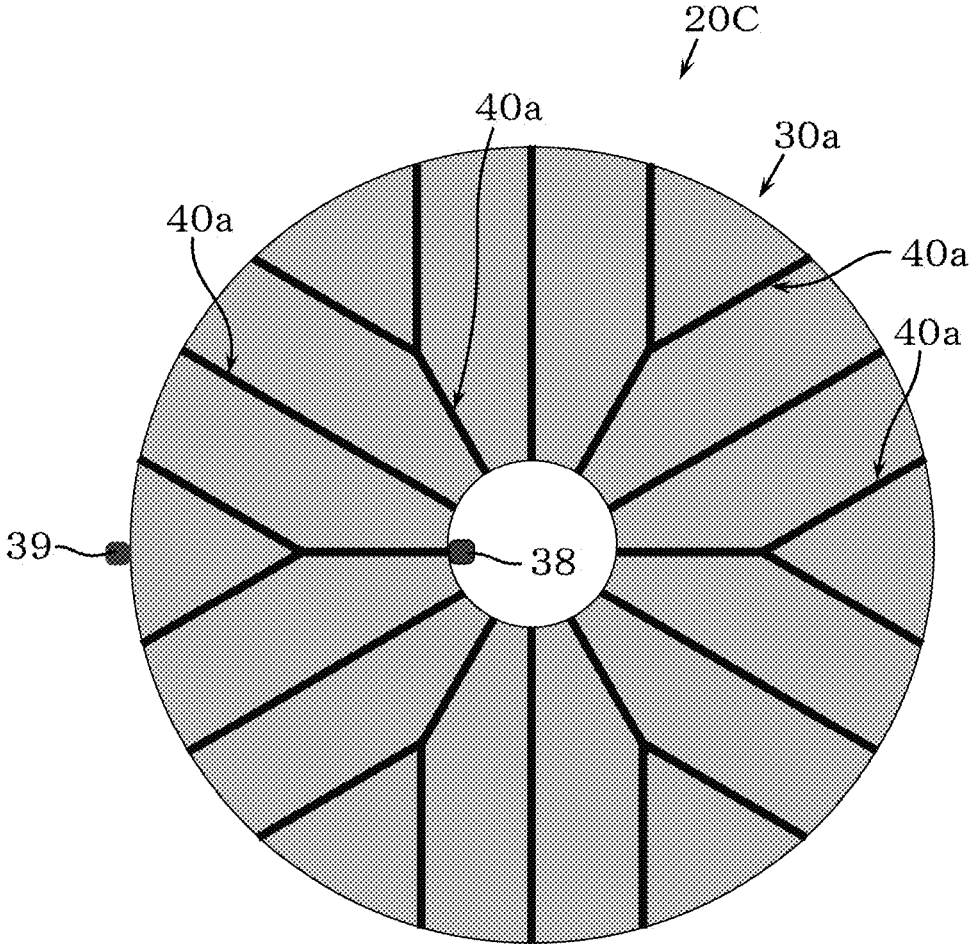
FIG. 10 is a rear view showing a second modification of the same voice coil diaphragm.

FIG. 10 shows a voice coil diaphragm 20C of the second modification. The voice coil diaphragm 20C differs from the voice coil diaphragm 20A in that the supporting bodies 40*a* are arranged to the coil body 30*a* in a manner where parts of the supporting bodies 40*a* branch so that the intervals between adjacent ones of the supporting bodies 40*a* become as even as possible at any positions. Comparing to the case where all the supporting bodies 40*a* are radially arranged as in the voice coil diaphragm 20A, a rise of the stiffness on the inner peripheral side can be prevented in the voice coil diaphragm 20C, thereby the sound quality can be improved. Note that the number and the arrangement of the supporting bodies are not limited by the above, but it can be selected as appropriate.

Figure 11:
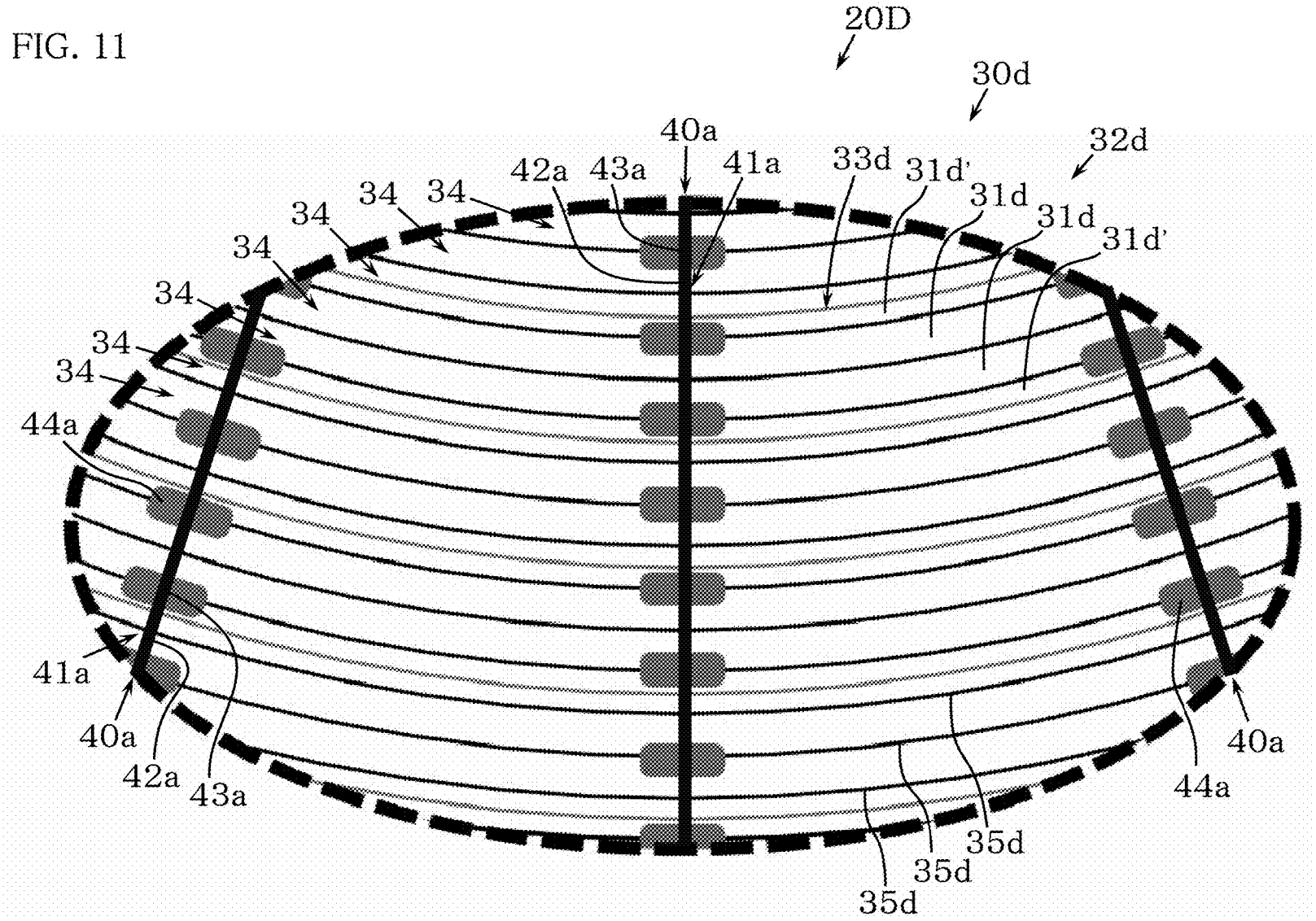
FIG. 11 is an enlarged rear view of the main part showing a third modification of the same voice coil diaphragm.
Figure 12:
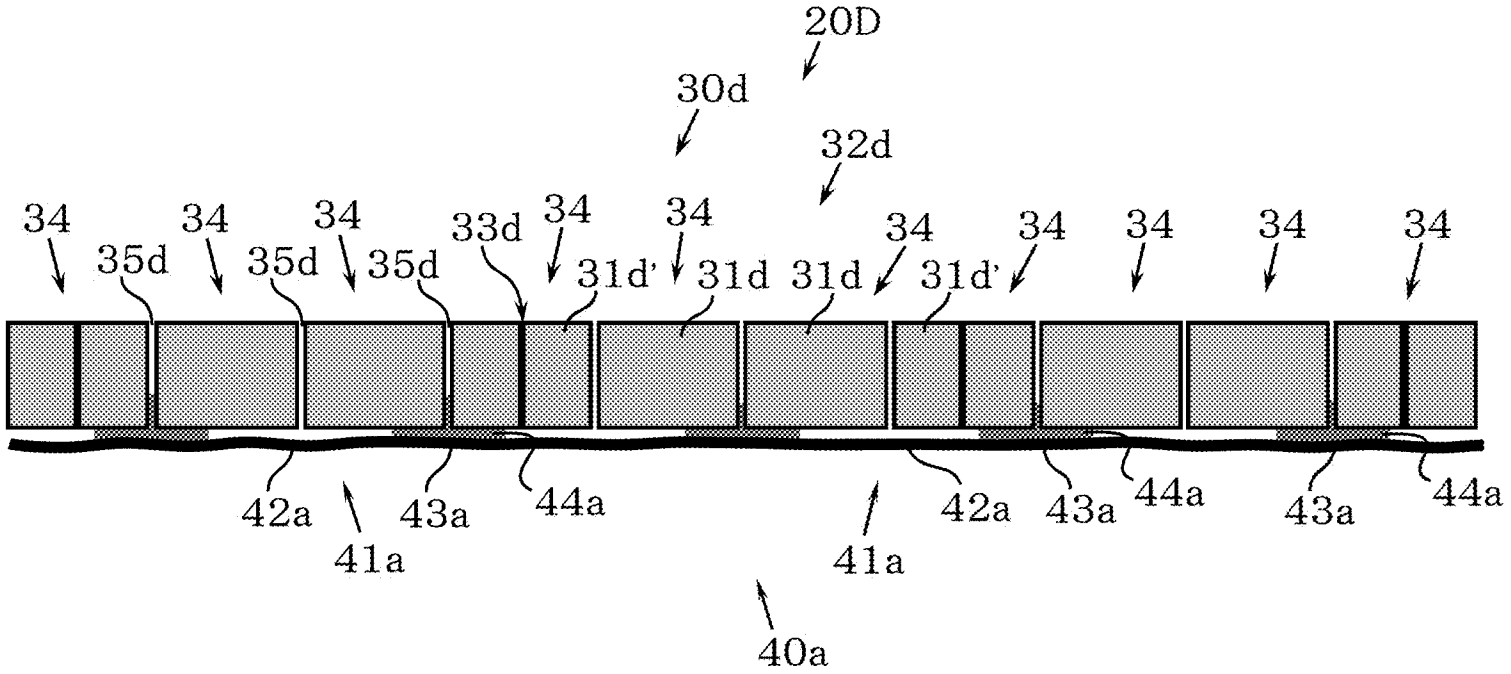
FIG. 12 is an end view of the main part showing a part of the voice coil diaphragm of the same modification cut in a radial direction at a position passing through one of supporting bodies.

FIGS. 11 and 12 show a voice coil diaphragm 20D of the third modification. The voice coil diaphragm 20D differs from the voice coil diaphragm 20A in that a conductive part 32*d* composing a coil body 30*d* includes two quadrilateral-cross-sectional conductive bodies 31*d* having a same width and two quadrilateral-cross-sectional conductive bodies 31*d*' each having a width that is a half of the width of each conductive body 31*d*, and in that an insulating part 33*d* is formed to be a thin layer. The two conductive bodies 31*d* disposed side by side so as to be adjacent to each other, and the two conductive bodies 31*d*' each disposed side by side with one of the conductive bodies 31*d* such that the two conductive bodies 31*d*' have the two conductive bodies 31*d* in between, are electrically connected in parallel. When the conductive part 32*d* is spirally wound, the conductive body 31*d*' on the outer peripheral side and the conductive body 31*d*' on the inner peripheral side are adjacent. So, by putting the insulating part 33*d* between these two conductive bodies 31*d*' and joining the two conductive bodies 31*d*' while insulating them, the two conductive bodies 31*d*' are made into one wound part 34. In the case of the voice coil diaphragm 20A, the coil body 30*a* is formed by winding the conductive bodies 31 and the insulating part 33, however, in the case of the voice coil diaphragm 20D, e.g., a conductor foil serving as the conductive part 32*d* is separated into the conductive bodies 31*d* and the conductive bodies 31*d*' by using three parallel separating parts 35*d* to form the coil body 30*d*. As a method for forming the separating parts 35*d*, a method of pressing, laser processing, or etching the conductor foil can be used. The adjacent conductive bodies 31*d*' are joined by the insulating part 33*d* after being separated through the same process as the separating parts 35*d*.

As was mentioned above, the width of each of the adjacent conductive bodies 31*d*' having the insulating part 33*d* therebetween is a half of the width of each of the other conductive bodies 31*d*. Since the total cross-sectional area of the two conductive bodies 31*d*' joined by the insulating part 33*d* is equal to the cross-sectional area of each of the other conductive bodies 31*d*, the cross-sectional area of the conductive part 32*d* is equivalent to three times of the cross-sectional area of each conductive body 31*d*. Therefore, the coil body 30*d* is in a winding state as in the case where three of the conductive bodies 31*d* are arranged side by side. Electrically, on the other hand, two each of the conductive bodies 31*d* and 31*d*' insulated by the wound insulating part 33*d* compose the conductive part 32*d*, and an acoustic signal current flows in an equipotential state.

Although the voice coil diaphragm 20A uses the insulating part 33 having a cross-sectional area approximate to the conductive body 31, in the voice coil diaphragm 20D, the insulating part 33*d* is formed into a layer to reduce the area and the mass, and thus, the sound quality is improved. Since the insulating part 33*d* is sandwiched and protected by the conductive bodies 31*d*', the insulating part 33*d* can be formed extremely thin, and thus, the influence on the sound quality can be minimized. Also, since the cross-sectional shape and the dimensions of the two conductive bodies 31*d*' joined by the insulating part 33*d* and those of each of the other conductive bodies 31*d* are almost the same, the mechanical properties in the voice coil diaphragm 20D become entirely uniform. In this way, a uniform vibration state can be obtained over the entire surface of the voice coil diaphragm 20D, and a high sound quality can be achieved. Further, in the voice coil diaphragm 20D, most of the surface (the front surface) of the voice coil diaphragm 20D (the coil body 30*d*) that is the sound radiating surface is occupied by the conductive bodies 31*d* and 31*d*' that are the driving part, and sound is directly emitted. In this respect as well, it is very advantageous for improving the sound quality.

Figure 13:
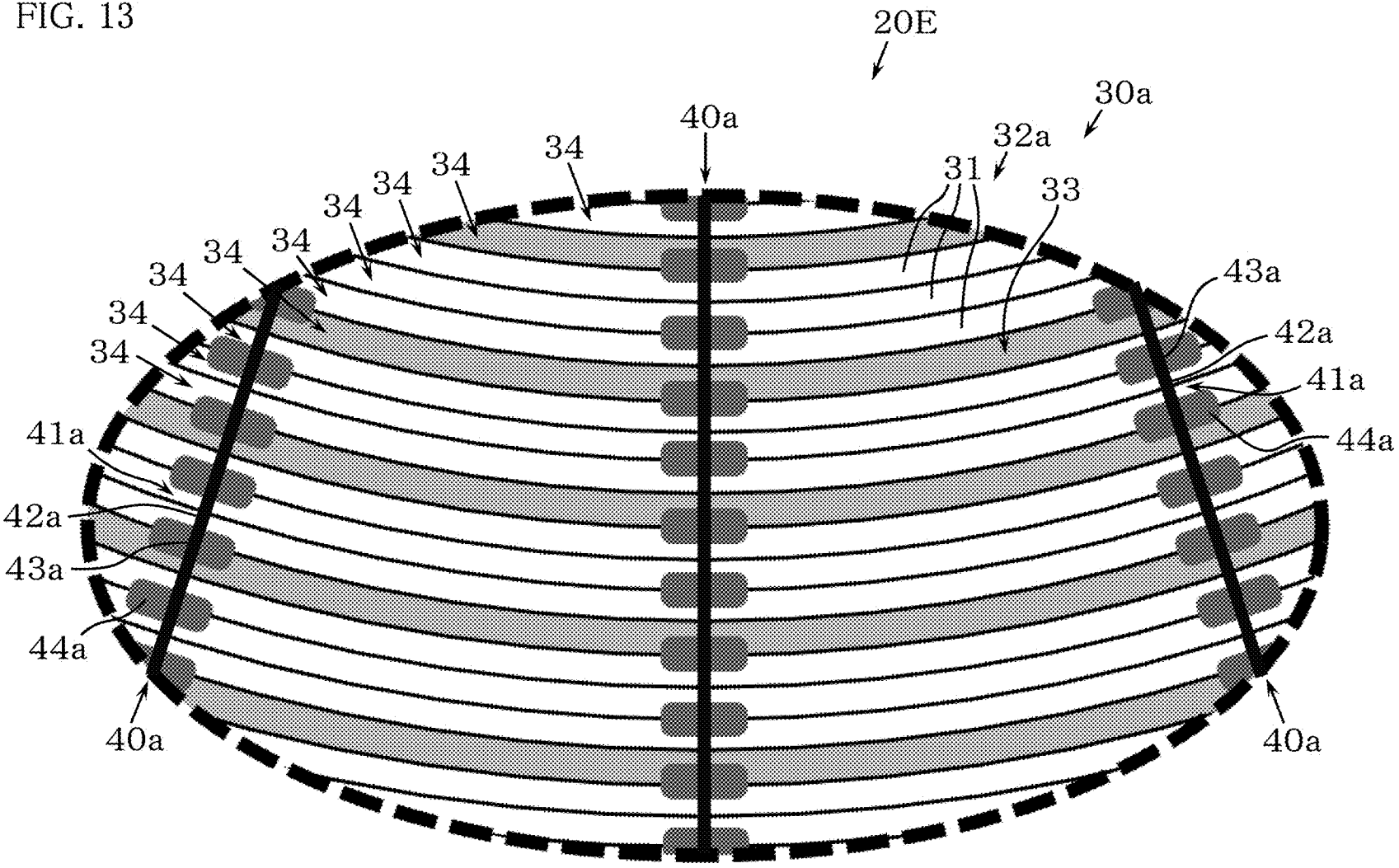
FIG. 13 is an enlarged rear view of the main part showing a fourth modification of the same voice coil diaphragm.

FIG. 13 shows a voice coil diaphragm 20E of the fourth modification. The voice coil diaphragm 20E differs from the voice coil diaphragm 20A in that the mutual joining parts 44*a* intermittently provided in the winding direction of the wound parts 34, are staggered with respect to the winding direction and the width directions of the wound parts 34. By staggering the mutual joining parts 44*a*, the mutual joining parts 44*a* can be provided between all the adjacent wound parts 34 in the radial directions (the width directions of the wound parts 34) while maintaining the overall stiffness of the voice coil diaphragm 20E low. Since the mutual joining parts 44*a* securely fix the adjacent wound parts 34, not only the misalignments become less likely to occur in each wound part 34, but also, even if a misalignment occurs in one of the wound parts 34, the misalignment is prevented from spreading to other parts. This makes it possible to support each wound part 34 (each conductive body 31 or the insulating part 33) at necessary points by using the joined supporting parts 43*a*, and also to effectively prevent the misalignments of each wound part in the winding direction and the width directions. Further, even if a misalignment occurs in each wound part 34, since the mutual joining parts 44*a* are provided between all the adjacent wound parts 34 in the radial directions, the misalignment is less likely to spread to other parts of the coil body 30*a*, thereby deformation or the like of the entire voice coil diaphragm 20E due to the misalignments can be effectively prevented.

Figure 14:
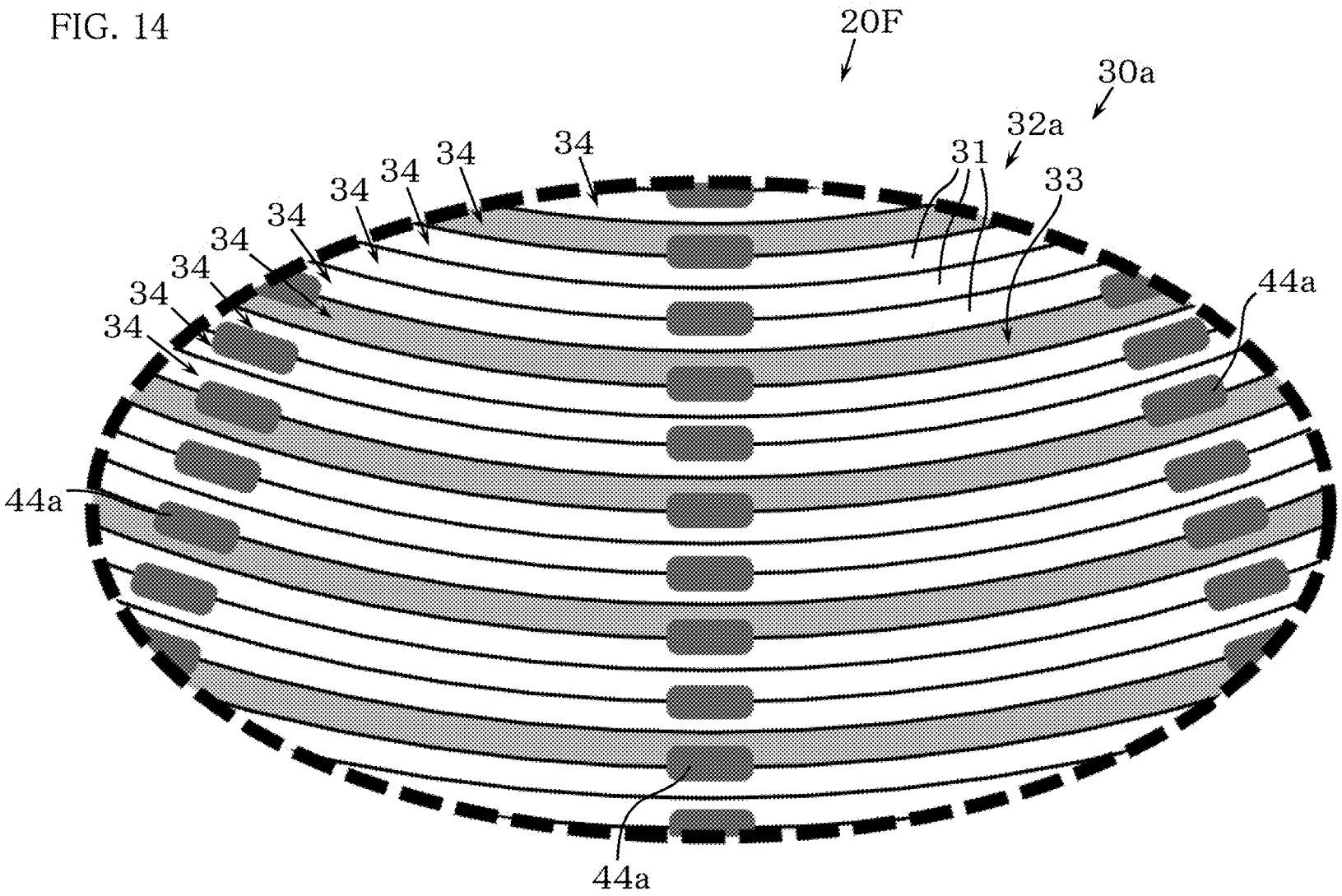
FIG. 14 is an enlarged rear view of the main part showing a fifth modification of the same voice coil diaphragm.

FIG. 14 shows a voice coil diaphragm 20F of the fifth modification. The voice coil diaphragm 20F differs from the voice coil diaphragm 20A in that the mutual joining parts 44*a* intermittently provided in the winding direction of the wound parts 34, are staggered with respect to the winding direction and the width directions of the wound parts 34, and in that the supporting bodies 40*a* are eliminated (omitted). That is, the voice coil diaphragm 20F is equivalent to the voice coil diaphragm 20E from which the supporting bodies 40*a* have been removed. In here, each mutual joining part 44*a* is a joining part for partially joining one of the wound parts 34 and an adjacent one of the other wound parts 34. By arranging the mutual joining parts 44*a* in a staggered manner with respect to the winding direction and the width directions of the wound parts 34, necessary points of each wound part 34 are fixed by the mutual joining parts 44*a*. In this way, the adjacent ones of the wound parts 34 support each other using the mutual joining parts 44*a* as the supporting points, and meanwhile, each wound part 34 becomes deformable in the front-back directions. Therefore, the supporting bodies 40*a* can be omitted. In this case, since each wound part 34 takes on the function as a supporting body, the stiffness of the voice coil diaphragm 20F depends on the material (the elasticity modulus) and the cross-sectional area of the wound parts 34, and the distance between the mutual joining parts 44*a* adjacent to each other in the winding direction. In a configuration like this, since the wound parts 34 are only partially joined with each other by the mutual joining parts 44*a*, each wound part 34 is less likely to be restrained, and the vibrations are less likely to propagate to the other wound parts 34, thereby the sound quality is improved. Further, in the voice coil diaphragm 20F, the adjacent wound parts 34 are securely fixed to each other by the mutual joining parts 44*a*, and so, the misalignments of the wound parts 34 in the winding direction or the front-back directions (the vibrating directions) are prevented. Also, the width direction displacement of each wound part 34 that causes the abnormal vibrations can be effectively suppressed.

For the mutual joining parts 44*a*, synthetic resin based adhesives such as epoxy-based and cyanoacrylate-based adhesives can be used instead of the silicone resin. However, at the locations where the conductive bodies 31 are joined with each other, a strong joining force can be obtained by using metal bonding such as soldering or wire bonding. In this case, besides, since the metal bonding is hard, it is advantageous also in terms of improving the sound quality. Also, when a highly-elastic (highly-resilient) nonmagnetic material such as beryllium copper, phosphor bronze, or a stainless steel wire for a nonmagnetic spring is selected as the material for the conductive bodies 31, the function of each conductive body 31 itself as a supporting body can be improved and it is effective also in terms of operational stability and durability.

Figure 15:
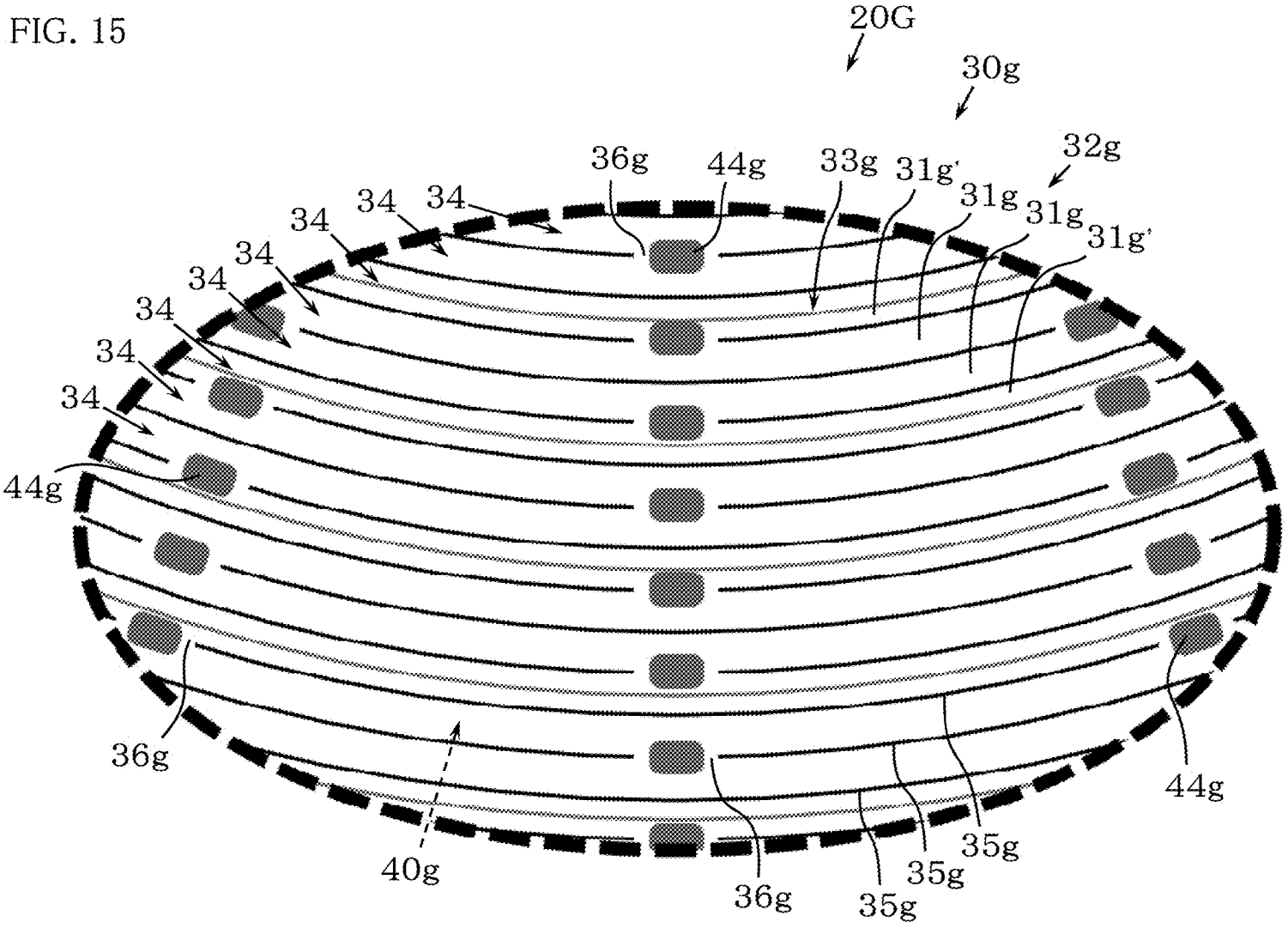
FIG. 15 is an enlarged rear view of the main part showing a sixth modification of the same voice coil diaphragm.
Figure 16:
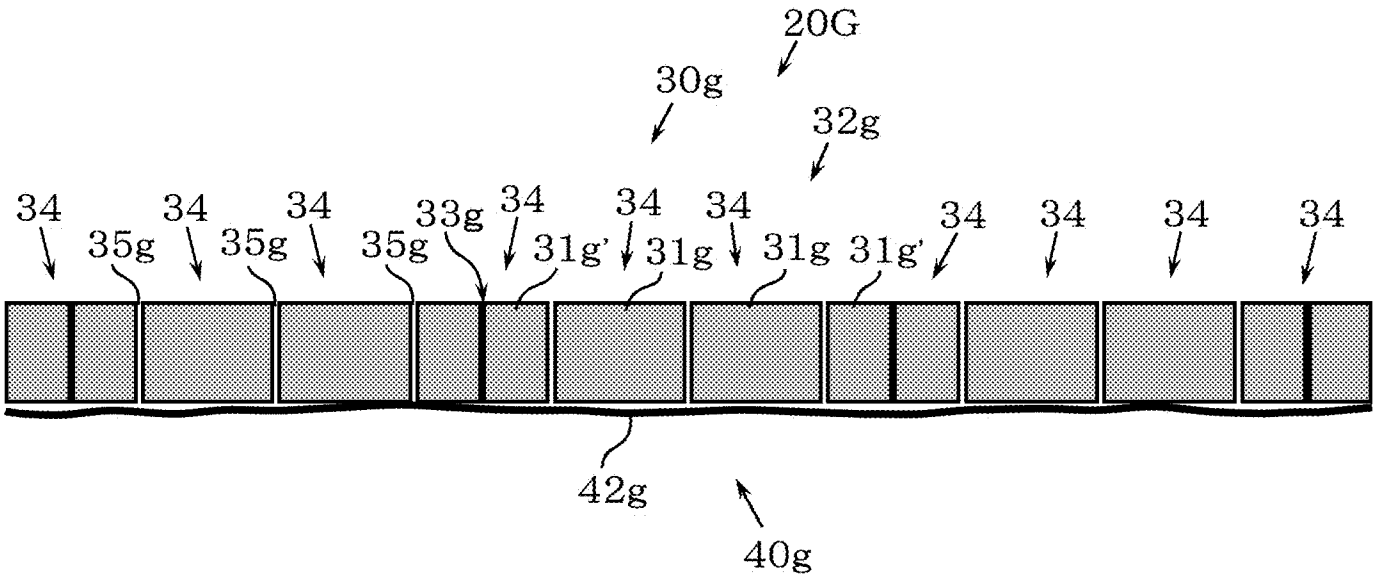
FIG. 16 is an end view of the main part showing a part of the voice coil diaphragm of the same modification cut in a radial direction at a position not passing through any of conductive body combined parts.
Figure 17:
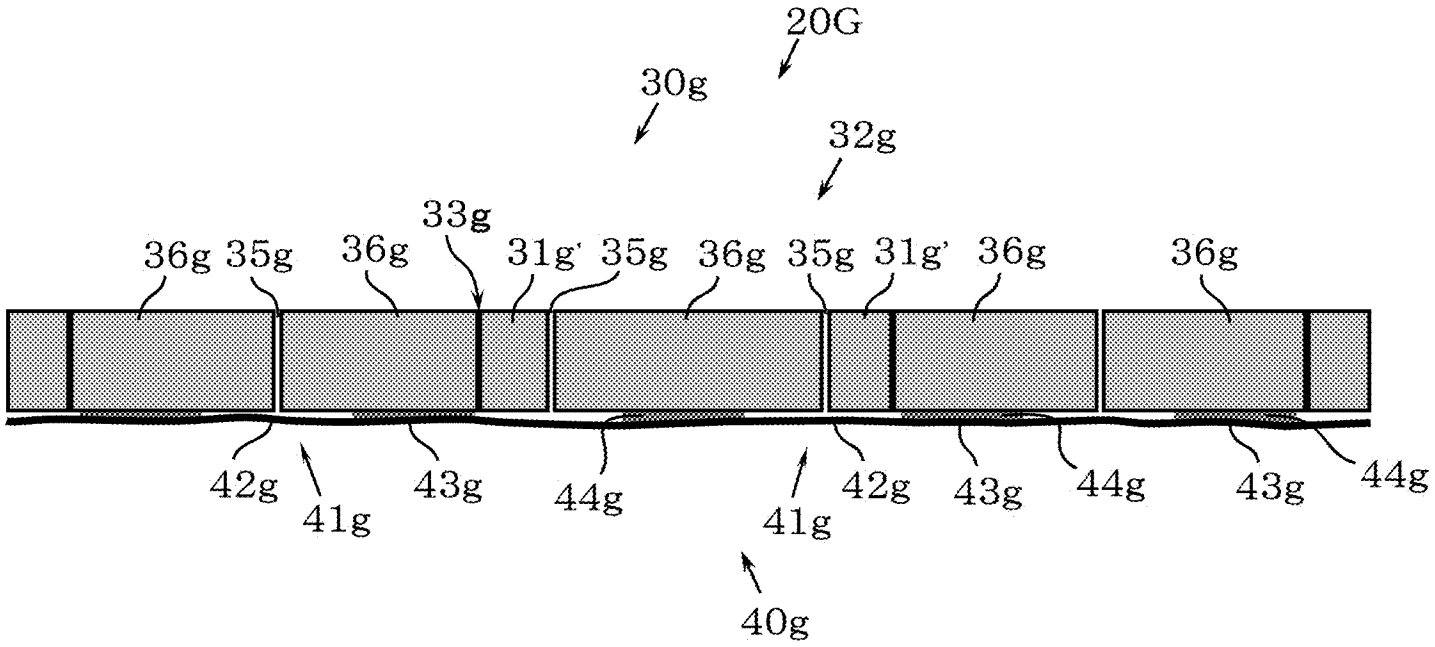
FIG. 17 is an end view of the main part showing a part of the voice coil diaphragm of the same modification cut in a radial direction at a position passing through one of mutual joining parts.

FIGS. 15 to 17 show a voice coil diaphragm 20G of the sixth modification. The voice coil diaphragm 20G differs from the voice coil diaphragm 20E in that a conductive part 32*g* composing a coil body 30*g* includes two quadrilateral-cross-sectional conductive bodies 31*g* having a same width and two quadrilateral-cross-sectional conductive bodies 31*g*' each having a width that is a half of the width of each conductive body 31*g*, in that an insulating part 33*g* is formed to be a thin layer, and in that a supporting body 40*g* in a film-like state is provided. The two conductive bodies 31*g* disposed side by side so as to be adjacent to each other and the two conductive bodies 31*g*' each disposed side by side with one of the conductive bodies 31*g* such that the two conductive bodies 31*g*' have the two conductive bodies 31*g* in between, are electrically connected in parallel. When the conductive part 32*g* is spirally wound, the conductive body 31*g*' on the outer peripheral side and the conductive body 31*g*' on the inner peripheral side are adjacent. So, by putting the insulating part 33*g* between these two conductive bodies 31*g*' and joining the two conductive bodies 31*g*', the two conductive bodies 31*g*' are made into one wound part 34. Regarding FIG. 15, although the entire surface (the nearer side in the figure) of the coil body 30*g* is covered by the supporting body 40*g*, the drawing shows a state where the entire surface of the coil body 30*g* can be seen through the supporting body 40*g* since the supporting body 40*g* is a thin film.

In the case of the voice coil diaphragm 20E, the coil body 30*a* is formed by winding the conductive bodies 31 and the insulating part 33, however, in the case of the voice coil diaphragm 20G, e.g., a conductor foil serving as the conductive part 32*g* is separated into the conductive bodies 31*g* and the conductive bodies 31*g*' by using three parallel separating parts 35*g* to form the wound parts 34 of the coil body 30*g*. Further, when forming the wound parts 34 by using the separating parts 35*g*, unseparated parts are provided, as conductive body combined parts 36*g*, intermittently in the winding direction of the wound parts 34 and the conductive body combined parts 36*g* are staggered with respect to the winding direction and the width directions of the wound parts 34. The method for manufacturing the coil body 30*g* is basically the same as the above-mentioned coil body 30*d*, and the only difference between the coil bodies 30*d* and 30*g* is whether or not having the conductive body combined parts 36*g*.

As shown in FIG. 17, to the supporting body 40*g*, movable linking parts 41*g* are formed at the positions overlapping the conductive body combined parts 36*g*. Each movable linking part 41*g* includes a movable part 42*g*, which faces the conductive body combined parts 36*g* each being a part of the wound parts 34 but is not joined with the conductive body combined parts 36*g*, and two joined supporting parts 43*g*, which are located one by one at both ends of the movable part 42*g* and each joined with one of the conductive body combined parts 36*g*. The conductive body combined parts 36*g* and the joined supporting parts 43*g* are joined by using mutual joining parts 44*g* made of a silicone resin. In here, the major part of the film-like supporting body 40*g* (i.e. other than the part occupied by the joined supporting parts 43*g*) is, as shown in FIG. 16, occupied by the movable parts 42*g* that face the wound parts 34 but are not joined with the wound parts 34. In this way, in the film-like supporting body 40*g*, the joined supporting parts 43*g* are provided at the positions that overlap the conductive body combined parts 36*g* which are less likely to move, i.e. less likely to deform, in the coil body 30*g*. This prevents the supporting body 40*g* (the joined supporting parts 43*g*) from blocking the originally intended operation (vibrations) of the wound parts 34. Furthermore, by joining the wound parts 34 and the joined supporting parts 43*g* by using the mutual joining parts 44*g* that are each in a point shape, the volume of the mutual joining parts 44*g* that fall into substances other than the driving part can be reduced as much as possible in order to improve the sound quality.

In the voice coil diaphragm 20E, the necessary points of the adjacent wound parts 34 are joined by the mutual joining parts 44*a*, and the wound parts 34 and the supporting bodies 40*a* (the joined supporting parts 43*a*) are joined via the mutual joining parts 44*a*. However, in the voice coil diaphragm 20G, by providing to the conductive part 32*g* the unseparated parts that are to be the conductive body combined parts 36*g*, adjacent ones of the wound parts 34 are partially combined (integrated). As a result, the adjacent wound parts 34 are strongly fixed to each other in the region of the conductive body combined parts 36*g*, and thus, the width direction displacement of the wound parts 34 (the conductive bodies 31*g* and 31*g*') that causes the abnormal vibrations becomes much less likely to occur.

Generally speaking, in a loudspeaker that reproduces the low-frequency range, the area of the diaphragm is large and the amplitude of the diaphragm is also large, and so, the misalignments in various directions are likely to occur in each part (each wound part) of the planar coil body. Besides, the range to which these misalignments spread expands, and this significantly influences on the deformation of the coil body. In contrast, in the voice coil diaphragm 20G, since the conductive body combined parts 36*g* are provided between all the adjacent wound parts in the radial directions, even when a misalignment occurs in one of the wound parts 34 that locates at a position apart from the conductive body combined parts 36*g*, each conductive body combined part 36*g* prevents the misalignment from spreading to other parts of the wound parts 34. In this way, unevenness between the wound parts is prevented from occurring and deformation of the entire coil body 30*g* due to the misalignments is also prevented. If the amplitude of the voice coil diaphragm 20G is large, the deformation in a wavy shape becomes large, and the differences of the front-back direction displacements between the adjacent wound parts 34 become large. In such a case, the gap of each separating part 35*g* expands in the front-back directions and this facilitates the air flow between the front side and the back side of the voice coil diaphragm 20G. To cope with this, in the voice coil diaphragm 20G, by forming the supporting body 40*g* in a film state, the air flow is blocked by the supporting body 40*g*. The voice coil diaphragm 20G having the features explained above can be suitably used especially as a loudspeaker for the low-frequency range.

The present invention has been described above with reference to the embodiments. However, the present invention is not limited to the structures described in the above embodiments, and the present invention includes other embodiments and modifications conceivable within the scope of the matters described in the scope of the claims.

Although the voice coil diaphragms each in a planar shape are described in the above embodiments, these voice coil diaphragm can be made, e.g., each in a three dimensional shape having inclined or perpendicular surfaces, as in patent literature 5. That is, e.g., a coil body made in a three dimensional shape by winding the conductive part and the insulating part while folding and/or curving them, or a coil body made in a three dimensional shape by folding and/or curving the conductive part and the insulating part after winding them in a planar shape, can be used. Also, a coating film may be provided to a part or the whole of the conductive part if needed. Although the cases where the conductive part is composed of a plurality of the conductive bodies arranged side by side so as to be in a planar shape are explained in the above embodiments, the number of the conductive bodies can be selected as appropriate, and it can be one.

As the method for manufacturing the coil bodies 30*d* and 30*g*, the method of pressing, laser processing, or etching the conductive part formed in a planar shape in advance and forming the separating parts 35*d* and 35*g* or the like, is explained in the above embodiments. However, the portions of the conductive bodies 31*d*, 31*d*', 31*g*, and 31*g*', which are other than the separating parts 35*d* and 35*g* and the insulating parts 33*d* and 33*g*, can be formed also by using a method of vapor deposition, sputtering, plating or the like.

Further, the structure of the magnet plate used in combination with each voice coil diaphragm in the above embodiments is not limited to the ones described in the above embodiments, and can be selected as appropriate. Thus, if a diaphragm of an electroacoustic transducer using a conventional magnet plate can be replaced with any one of the voice coil diaphragms of the above embodiments, by adopting these diaphragms, the sound quality can be improved.

INDUSTRIAL APPLICABILITY

The voice coil diaphragm according to the present invention can be utilized for an electroacoustic transducer which can perform the conversion from electrical signals to sound with an unprecedented high quality such as a loudspeaker, headphones, and earphones, and for an electroacoustic transducer, which can perform the conversion from sound to electrical signals with a high quality such as a microphone and an acoustic wave sensor.

REFERENCE SIGNS LIST

10, 10A, 10Z: electroacoustic transducer (loudspeaker), 20, 20A, 20B, 20C, 20D, 20E, 20F, 20G, 20Z: voice coil diaphragm, 21B: inner peripheral side buffer part, 22B: main vibrating part, 23B: outer peripheral side buffer part, 30, 30*a*, 30*b*, 30*d*, 30*g*: coil body, 31: conductive body, 31*b*: additional conductive body, 31*d*, 31*d*', 31*g*, 31*g*', 31*z*: conductive body, 32, 32*a*, 32*b*, 32*c*, 32*d*, 32*g*: conductive part, 33, 33*d*, 33*g*: insulating part, 33*z*: gap, 34: wound part, 35*d*, 35*g*: separating part, 36*g*: conductive body combined part, 38: inner peripheral side terminal, 39: outer peripheral side terminal, 40, 40*a*, 40*b*, 40*g*, 40*z*: supporting body, 41, 41*a*, 41*g*: movable linking part, 42, 42*a*, 42*g*, 42*z*: movable part, 43, 43*a*, 43*g*, 43*z*: joined supporting part, 44, 44*a*, 44*g*: mutual joining part, 60, 60A, 60Z: magnet plate, 61: central region magnet, 62, 62*a*: basic region magnet, 62', 62*a*': small magnet, 63, 63*a*: outer peripheral region magnet, 63': small magnet, 65*z*: band-shaped magnet, 71: sound passage hole, 81: main frame, 82: front frame, 83: central frame, 84: outer peripheral frame, 85, 85*z*: back frame, 86: sound passage hole

The invention claimed is:

1. A voice coil diaphragm having a planar coil body formed with a conductive part in a winding state, being disposed facing a magnet plate, and being used in (a) an electroacoustic transducer generating sound by vibrating the conductive part by using an electro-magnetic force, the electro-magnetic force generated by a magnetic field and an acoustic signal current, the magnetic field created by the magnet plate, the acoustic signal current flowing in the conductive part, or (b) an electroacoustic transducer generating an acoustic signal current in the conductive part by using a magnetic field and vibrations of the conductive part, the magnetic field created by the magnet plate, the vibrations of the conductive part deriving from sound, the coil body of the voice coil diaphragm comprising:

the conductive part composed of a conductive body or of a plurality of conductive bodies arranged side by side so as to be in a planar shape; and an insulating part for insulating the conductive part, wherein a plurality of wound parts that are separated from each other and arranged side by side are formed in the coil body by arranging the conductive body, or the conductive bodies, and the insulating part in a winding state, further wherein the wound parts (1) are disposed in a manner where each of the wound parts comes into a partial contact with an adjacent one or more of the other wound parts at least when vibrating, and are each linked by movable linking parts with other ones of the wound parts arranged side by side, or (2) are each joined intermittently in the winding direction with an adjacent one or more of the other wound parts by using joining parts.

2. The voice coil diaphragm set forth in claim 1, wherein a supporting body with which the movable linking parts are provided is included, the supporting body is disposed on one side of the coil body, and the movable linking parts each include a movable part, which faces the wound parts but is not joined with the wound parts, and two joined supporting parts, which are located one by one at both ends of the movable part and each joined with at least one of the wound parts.

3. The voice coil diaphragm set forth in claim 1, wherein the joining parts are staggered with respect to the winding direction and the width directions of the wound parts.

4. The voice coil diaphragm set forth in claim 1, wherein the conductive part has a coating film on a part of or the whole of the conductive part.

5. The voice coil diaphragm set forth in claim 1, wherein the conductive part is composed of a plurality of the conductive bodies arranged side by side, and adjacent ones of the conductive bodies that have the insulating part therebetween are joined by the insulating part.

6. The voice coil diaphragm set forth in claim 1, wherein the insulating part is composed of a conductive body not for driving and an insulating coating film for covering the outer peripheral surface of the conductive body not for driving.

* * * * *